US009652957B2

(12) United States Patent
Urrutia et al.

(10) Patent No.: US 9,652,957 B2
(45) Date of Patent: May 16, 2017

(54) SMOKE DETECTOR CHAMBER ARCHITECTURE AND RELATED METHODS

(71) Applicant: Google Inc., Mountain View, CA (US)

(72) Inventors: Carlos Urrutia, San Jose, CA (US); Adam Mittleman, Redwood City, CA (US); Andrew Goldenson, Palo Alto, CA (US); Nicholas Webb, Menlo Park, CA (US); Mathias Schmidt, Emeryville, CA (US); Anurag Gupta, Palo Alto, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 15/336,399

(22) Filed: Oct. 27, 2016

(65) Prior Publication Data

US 2017/0053508 A1 Feb. 23, 2017

Related U.S. Application Data

(63) Continuation of application No. 14/713,975, filed on May 15, 2015, now Pat. No. 9,514,623.

(51) Int. Cl.
*G08B 21/00* (2006.01)
*G08B 17/10* (2006.01)

(52) U.S. Cl.
CPC ..... *G08B 17/10* (2013.01)

(58) Field of Classification Search
CPC ..... G08B 17/10
USPC ..... 340/628, 629, 630
See application file for complete search history.

(56) References Cited

U.S. PATENT DOCUMENTS

| | | | |
|---|---|---|---|
| 6,756,905 | B2 | 6/2004 | Rattman et al. |
| 6,831,289 | B1 | 12/2004 | Preikszas et al. |
| 7,233,253 | B2 | 6/2007 | Qualey, III |
| 7,884,731 | B2 | 2/2011 | Mizuo |
| 8,847,772 | B2 | 9/2014 | Marks et al. |
| 9,514,623 | B1 | 12/2016 | Urrutia et al. |
| 2014/0333928 | A1 | 11/2014 | Erdtmann |
| 2015/0103346 | A1 | 4/2015 | Erdtmann |

FOREIGN PATENT DOCUMENTS

WO 2016/186884 A1 11/2016

OTHER PUBLICATIONS

International Search Report and Written Opinion mailed Aug. 4, 2016, for International Patent Application No. PCT/US2016/031530, 20 pages.

*Primary Examiner* — Jeffery Hofsass
(74) *Attorney, Agent, or Firm* — Kilpatrick Townsend & Stockton LLP

(57) ABSTRACT

Various arrangements for using multiple wavelengths of electromagnetic radiation to detect smoke by a smoke detector are present. Multiple modes of the smoke detector may be used in which a first wavelength of electromagnetic radiation is emitted into a smoke chamber while a second electromagnetic radiation emitter is disabled, a period of time is waited, and a second wavelength of electromagnetic radiation is emitted into the smoke chamber while the first emitter is disabled. Depending on the mode of the smoke detector, the period of wait time may be varied.

20 Claims, 23 Drawing Sheets

SMOKE DETECTOR CHAMBER ARCHITECTURE AND RELATED METHODS

CROSS-REFERENCE TO RELATED APPLICATION

This application is a continuation of U.S. application Ser. No. 14/713,975 filed May 15, 2015, the entire disclosure of which is hereby incorporated by reference for all purposes.

BACKGROUND

In some forms of smoke detectors, such as optical smoke detectors, a smoke chamber is used. A smoke chamber is used for creating a controlled environment in which electromagnetic radiation is emitted and sensed. Within the smoke chamber, effective detection of different sizes of particulate matter may be desired.

SUMMARY

In various embodiments, a method for using multiple wavelengths of electromagnetic radiation to detect smoke by a smoke detector may be presented. The method may include, while the smoke detector is set to a first mode, emitting, by a first electromagnetic radiation emitter, a first wavelength of electromagnetic radiation into a smoke chamber while a second electromagnetic radiation emitter is disabled. The method may include, while in the first mode, waiting, by the smoke detector, a first period of time following emitting the first wavelength of electromagnetic radiation into the smoke chamber with the first and second electromagnetic radiation emitters disabled. The method may include, while in the first mode, emitting, by the second electromagnetic radiation emitter, a second wavelength of electromagnetic radiation into the smoke chamber while the first electromagnetic radiation emitter is disabled following waiting the first period of time. The method may include, while in the first mode, determining, by the smoke detector, at least partially based on a first amount of smoke detected within the smoke chamber, whether to set the smoke detector to a second mode. While the smoke detector is set to the second mode, the method may include emitting, by the first electromagnetic radiation emitter, the first wavelength of electromagnetic radiation into the smoke chamber while the second electromagnetic radiation emitter is disabled. The method may include, while in the second mode, waiting, by the smoke detector, a second period of time following emitting the first wavelength of electromagnetic radiation into the smoke chamber with the first and second electromagnetic radiation emitters disabled, wherein the second period of time is shorter in duration than the first period of time. The method may include, while in the second mode, emitting, by the second electromagnetic radiation emitter, the second wavelength of electromagnetic radiation into the smoke chamber while the first electromagnetic radiation emitter is disabled following waiting the second period of time.

Embodiments of such a method may include one or more of the following: While the smoke detector is set to a third mode, the method may include emitting, by the first electromagnetic radiation emitter, the first wavelength of electromagnetic radiation into the smoke chamber. The method may include, while in the third mode, waiting, by the smoke detector, a third period of time following emitting the first wavelength of electromagnetic radiation into the smoke chamber, the third period of time being longer in duration than the first period of time and the second period of time. The method may include, while in the third mode, emitting, by the first electromagnetic radiation emitter, the first wavelength of electromagnetic radiation into the smoke chamber following waiting the third period of time, such that the second electromagnetic radiation emitter is not activated for detection of smoke while the smoke detector is set to the third mode. The method may include determining, by the smoke detector, at least partially based on an absence of smoke within the smoke chamber, to set the smoke detector to the third mode. The method may include testing, by the smoke detector, the second electromagnetic radiation emitter while the smoke detector is set to the third mode once during a test window. The test window may be at least 180 seconds in length. The third period of time may be at least 6 seconds. The method may include determining, by the smoke detector, at least partially based on a second amount of smoke within the smoke chamber being detected, to set the smoke detector to the second mode, the second amount of smoke being less than the first amount of smoke. The first wavelength may be infrared and the second wavelength may be blue. The method may include detecting, using an electromagnetic sensor, a first measured amount of the first wavelength of electromagnetic radiation in the smoke chamber via forward scattering. The method may include detecting, using the electromagnetic sensor, a second measured amount of the second wavelength of electromagnetic radiation in the smoke chamber via forward scattering. Determining, by the smoke detector, at least partially based on the first amount of smoke detected within the smoke chamber whether to set the smoke detector to the second mode may include: calculating, by a processor of the smoke detector, a metric based on: the first measured amount, a stored infrared scaling value, the second measured amount, and a stored blue scaling value; and using, by the processor of the smoke detector, the metric to determine whether to set the smoke detector to the second mode. Using, by the processor of the smoke detector, the metric to determine whether to set the smoke detector to the second mode may include: evaluating, by the processor of the smoke detector, a number of instances within a sliding time window that the metric has exceeded a defined threshold value; and causing, by the smoke detector, the smoke detector to be set to the second mode based on the number of instances within the sliding time window exceeding the defined threshold value. The method may include outputting, by the smoke detector, an auditory warning that a smoke level is rising in response to the smoke detector being set to the second mode, wherein the auditory warning does not include an alarm sounding.

In some embodiments, a smoke detector for using multiple wavelengths of electromagnetic radiation to detect smoke is presented. The smoke detector may include a smoke chamber. The smoke detector may include an electromagnetic sensor positioned to receive electromagnetic radiation within the smoke chamber. The smoke detector may include a first electromagnetic radiation emitter that emits electromagnetic radiation at a first wavelength into the smoke chamber. The smoke detector may include a second electromagnetic radiation emitter that emits electromagnetic radiation at a second wavelength into the smoke chamber. The smoke detector may include a processing system that controls activation of the first electromagnetic radiation emitter and the second electromagnetic radiation emitter. The processing system may set the smoke detector to a first mode, during which the processing system may: cause the first electromagnetic radiation emitter to emit the first wavelength of electromagnetic radiation into the smoke chamber, during which the second electromagnetic radiation emitter is disabled; wait a first period of time following the first electromagnetic radiation emitter emitting the first wavelength of electromagnetic radiation into the smoke chamber, during the first period of time, neither the first electromagnetic radiation emitter nor the second electromagnetic radiation emitter are active; and cause the second electromagnetic radiation emitter to emit the second wavelength of electromagnetic radiation into the smoke chamber following waiting the first period of time, during which the first electromagnetic radiation emitter is disabled.

Embodiments of such a smoke detector may include one or more of the following features: The processing system may determine whether to set the smoke detector to a second mode. The processing system may, while the smoke detector is set to the second mode: cause the first electromagnetic radiation emitter to emit the first wavelength of electromagnetic radiation into the smoke chamber while the second electromagnetic radiation emitter is disabled; wait a second period of time following emitting the first wavelength of electromagnetic radiation into the smoke chamber, wherein the second period of time is shorter than the first period of time and the first and second electromagnetic radiation emitters are disabled; and cause the second electromagnetic radiation emitter to emit the second wavelength of electromagnetic radiation into the smoke chamber following waiting the second period of time while the first electromagnetic radiation emitter is disabled.

The processing system may be further configured to set the smoke detector to a third mode. While the smoke detector is set to the third mode, the processing system may cause the first electromagnetic radiation emitter to emit the first wavelength of electromagnetic radiation into the smoke chamber. The processing system may wait a third period of time following causing the first electromagnetic radiation emitter to emit the first wavelength of electromagnetic radiation into the smoke chamber, the third period of time being longer in duration than the first period of time and the second period of time, during the third period of time, the first and the second electromagnetic radiation emitters are disabled. The processing system may cause the first electromagnetic radiation emitter to emit the first wavelength of electromagnetic radiation into the smoke chamber following waiting the third period of time, such that the second electromagnetic radiation emitter is not activated for detection of smoke while the smoke detector is set to the third mode. The processing system may determine, at least partially based on an absence of deflected electromagnetic radiation measured within the smoke chamber by the electromagnetic sensor, to set the smoke detector to the third mode. The processing system may test the second electromagnetic radiation emitter while the smoke detector is set to the third mode on a periodic basis. The first wavelength emitted by the first electromagnetic radiation emitter may be infrared and the second wavelength emitted by the second electromagnetic radiation emitter may be blue light.

In some embodiments, an apparatus for using multiple wavelengths of electromagnetic radiation to detect smoke is presented. The apparatus may include means for emitting a first wavelength of electromagnetic radiation into a smoke chamber while the apparatus is set to a first mode and while a means for emitting a second wavelength of electromagnetic radiation into the smoke chamber is disabled. The apparatus may include means for waiting a first period of time following emitting the first wavelength of electromagnetic radiation into the smoke chamber while the apparatus is set to the first mode. The apparatus may include means for emitting the second wavelength of electromagnetic radiation into the smoke chamber while the apparatus is set to the first mode and while the means for emitting the first wavelength of electromagnetic radiation is disabled following waiting the first period of time. The apparatus may include means for determining whether to set the apparatus to a second mode. The apparatus may include means for emitting the first wavelength of electromagnetic radiation into the smoke chamber while the apparatus is set to the second mode and while the means for emitting the second wavelength of electromagnetic radiation is disabled, The apparatus may include means for waiting a second period of time following emitting the first wavelength of electromagnetic radiation while the apparatus is set to the second mode and, wherein the second period of time is shorter in duration than the first period of time. The apparatus may include means for emitting the second wavelength of electromagnetic radiation into the smoke chamber while the apparatus is set to the second mode and while the means for emitting the first wavelength of electromagnetic radiation emitter is disabled following waiting the second period of time. In some embodiments, the first wavelength is infrared and the second wavelength is blue light.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

A smoke chamber that allows for increased airflow can improve the performance of an optical smoke detector. By increasing airflow and, possibly, channeling air to a center of the smoke chamber, the speed at which the smoke is detected may be increased. Further, by using multiple wavelengths of electromagnetic (EM) radiation, smoke from various types of fires, such as flaming fires and smoldering fires, may be detected faster. Such a smoke chamber may be designed such that alignment between one or more EM emitters and one or more EM sensors causes the one or more EM sensors to detect EM radiation deflected by particulate smoke matter via forward scattering.

A smoke chamber may be ideally configured to allow no light from outside of the smoke chamber into an airspace within the housing of the smoke chamber while still allowing for air to be readily exchanged between the airspace within the housing of the smoke chamber and the exterior environment (e.g., outside of the smoke chamber, such as the room in which the smoke detector is installed). The smoke chamber may include multiple parts, such as a top component and a bottom component that are manufactured separated and are coupled together to form the smoke chamber. The smoke chamber may have a circular cross-section and may have a surface that generally curves radially outward from a center axis of the smoke chamber. This surface may have a series of "steps" which are perpendicular protrusions on the curved surface that help prevent light from being reflected by the surface from the exterior environment into the smoke chamber. Along the radially curved surface, a series of airflow fins that are radially aligned with a center axis of the smoke chamber may be positioned. These airflow fins may serve to direct airflow towards the center of the smoke chamber, which can help smoke be detected quickly.

By increasing the airflow between the airspace and the exterior environment, it may be possible to wrap the air exchange portion of the smoke chamber with a mesh while still maintaining sufficient airflow to meet all relevant legal requirements and detect smoke from various types of fires in a timely fashion. A mesh may be wrapped around the smoke chamber to limit entry of undesired matter (e.g., dust, bugs) into the smoke chamber while still allowing smoke particulate matter entry. The mesh may be metallic and, along with a metallic cap and metallic base, may serve as a metallic shield (a Faraday cage or Faraday shield) that encompasses the smoke chamber, which decreases EM noise that can affect the one or more EM sensors.

Figure 1A:
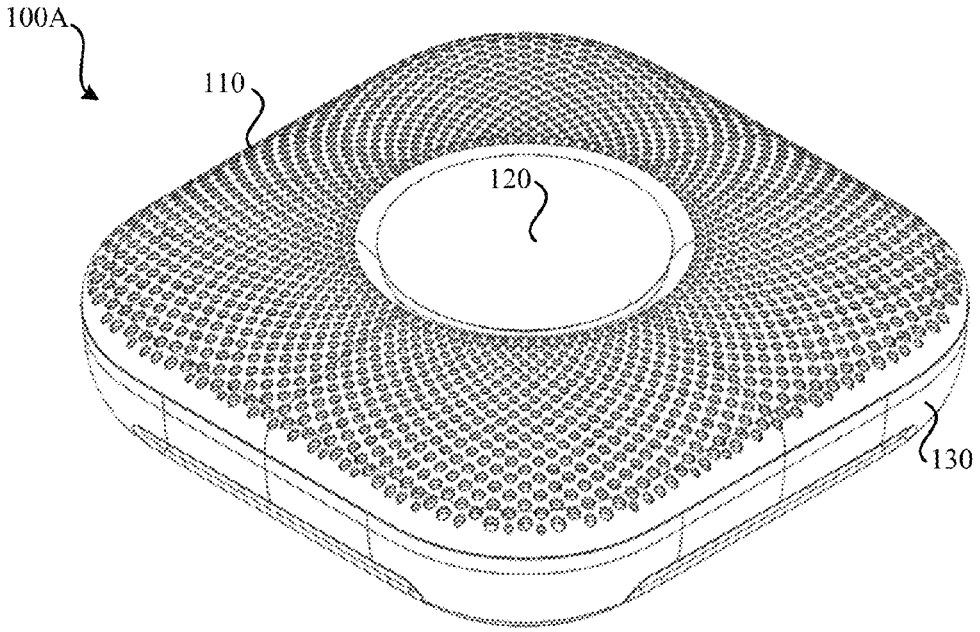
FIGS. 1A and 1B illustrate an embodiment of a smart combined smoke detector and carbon monoxide device.

Various embodiments of smoke chambers, including the above aspects and aspects yet to be noted, are described in detail in relation to the figures that follow. For overall understanding, a big picture view of a device that uses such a smoke chamber is first described. Such a device may be a dedicated smoke detector or a combination device, such as carbon-monoxide detector and smoke detector. FIG. 1A illustrates an embodiment of a smart combined smoke detector and carbon monoxide device 100A. Such an embodiment of a smart combined smoke detector and carbon monoxide device 100A may be suitable for mounting to a wall or ceiling in a room (or other location) within a structure in which smoke and/or carbon monoxide is to be monitored. Device 100A may be "smart," meaning the device 100A can communicate, likely wirelessly, with one or more other devices or networks. For instance, device 100A may communicate with a remote server via the Internet and, possibly, a home wireless network (e.g., an IEEE 802.11a/b/g network, 802.15 network, such as using the Zigbee® or Z-wave® specification). Such a smart device may allow for a user to interact with the device via wireless communication, either via a direct or network connection between a computerized device (e.g., cellular phone, tablet computer, laptop computer, or desktop computer) and the smart device.

FIG. 1A illustrates an angular top projection view of combined smoke detector and carbon monoxide device 100A. Device 100A may generally be square or rectangular and have rounded corners. Visible in the angular top projection view are various components of the combined smoke detector and carbon monoxide device 100A, including: cover grille 110, lens/button 120, and enclosure 130. Cover grille 110 may serve to allow air to enter combined smoke detector and carbon monoxide device 100A through many holes while giving device 100A a pleasing aesthetic appearance. Cover grille 110 may further serve to reflect light into the external environment of device 100A from internal light sources (e.g., LEDs). Light may be routed internally to cover grille 110 by a light pipe, noted in relation to FIGS. 2A, 2C, and 2D. It should be understood that the arrangement of holes and shape of cover grille 110 may be varied by embodiment. Lens/button 120 may serve multiple purposes. First, lens/button 120 may function as a lens, such as a Fresnel lens, for use by a sensor, such as an infrared (IR) sensor, located within device 100A behind lens/button 120 for viewing the external environment of device 100A. Additionally, lens/button 120 may be actuated by a user by pushing lens/button 120. Such actuation may serve as user input to device 100A. Enclosure 130 may serve as a housing for at least some of the components of device 100A.

Figure 1B:
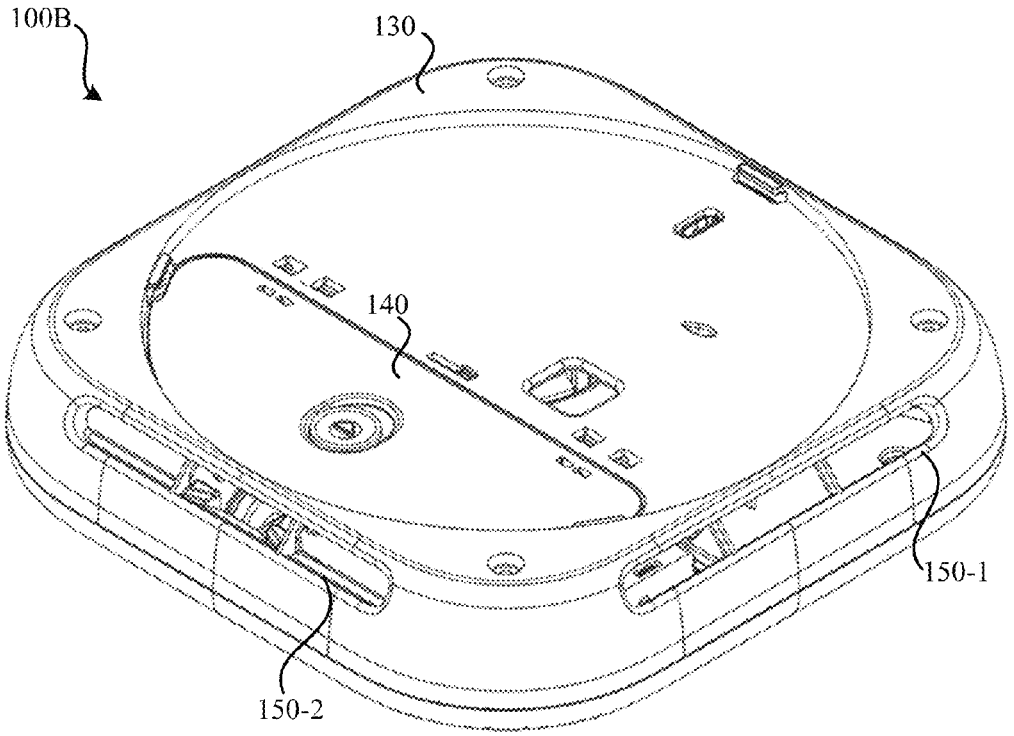

FIG. 1B illustrates an angular bottom projection view of a smart combined smoke detector and carbon monoxide device 100B. It should be understood that device 100A and device 100B may be the same device viewed from different angles. Visible from this view is a portion of enclosure 130. On enclosure 130, battery compartment door 140 is present through which a battery compartment is accessible. Also visible are airflow vents 150-1 and 150-2, which allow air to pass through enclosure 130 and enter the smoke chamber of device 100B.

Figure 2A:
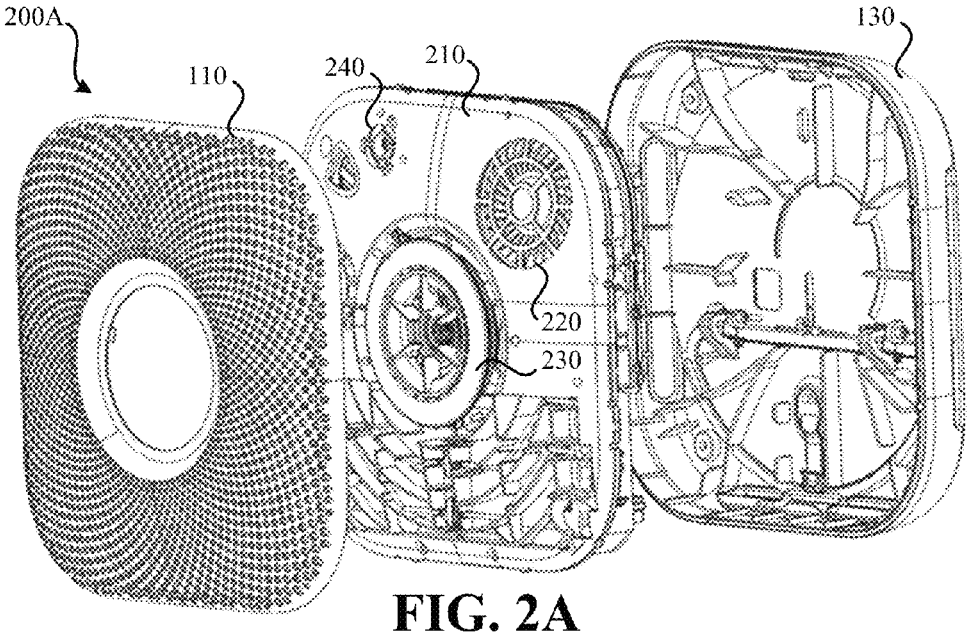
FIGS. 2A, 2B, 2C, and 2D illustrate an embodiment of an exploded smart combined smoke detector and carbon monoxide device.
Figure 2B:
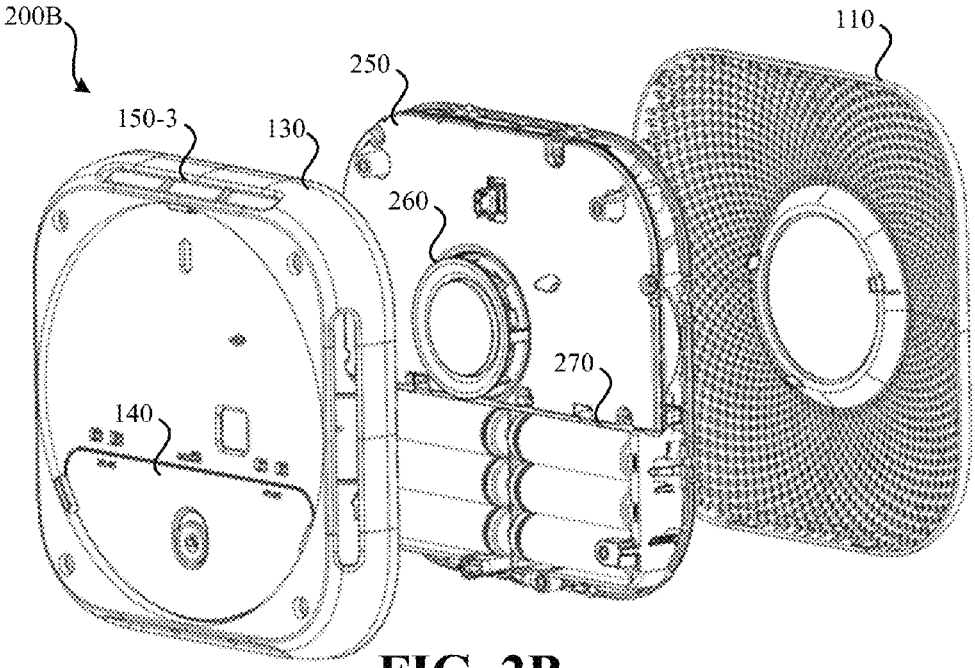

FIGS. 2A, 2B, 2C, and 2D illustrate an embodiment of an exploded smart combined smoke detector and carbon monoxide device. The devices of FIGS. 2A-2D can be understood as representing various views of devices 100A and 100B of FIGS. 1A and 1B, respectively. In FIG. 2A, device 200A is shown having cover grille 110 and enclosure 130, which together house main chassis 210. Main chassis 210 may house various components that can be present in various embodiments of device 200A, including speaker 220, light pipe 230, and microphone 240. FIG. 2B of an embodiment of device 200B can be understood as illustrating the same device of FIG. 2A, from a different viewpoint. In FIG. 2B, cover grille 110, enclosure 130, airflow vent 150-3, battery compartment door 140 are visible. Additionally visible is laminar flow cover 250, which forms a shield between an underlying circuit board and enclosure 130. Protruding through cover 250 is smoke chamber 260. A gap may be present between enclosure 130 and laminar flow cover 250 to allow airflow through airflow vents 150 to have a relatively unobstructed path to enter and exit smoke chamber 260. Also present in FIG. 2B are multiple batteries, which are installed within battery compartment 270 of device 200B and which are accessible via battery compartment door 140. Some or all components on main circuit board 288 may be at least partially covered by one or more laminar flow covers. Such laminar flow covers (e.g., laminar flow cover 250) can help laminar air flow within the device and prevent a user from inadvertently touching a component that could be sensitive to touch, such as via electro-static discharge.

Figure 2C:
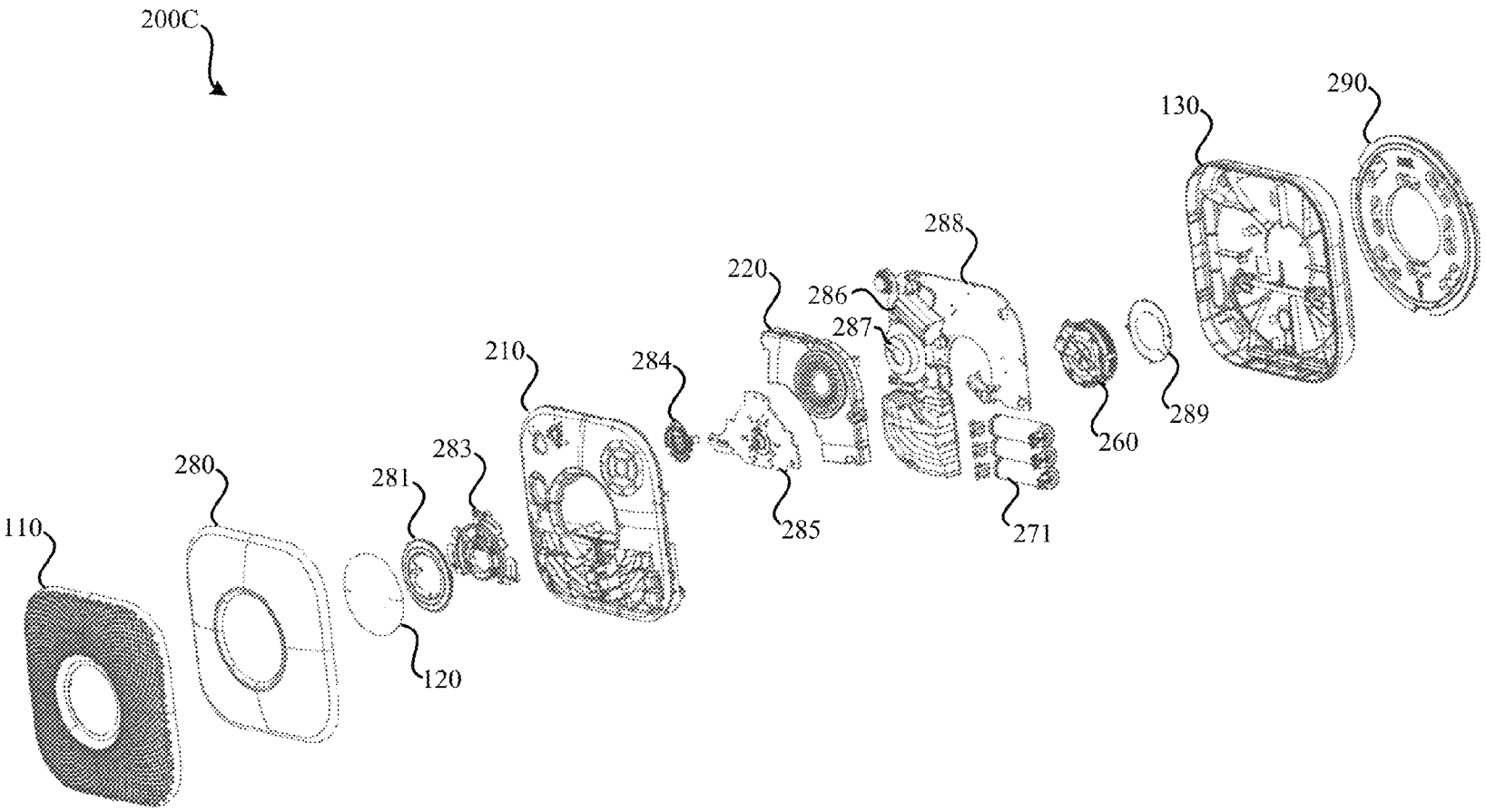

FIG. 2C represents a more comprehensive exploded view of a smart combined smoke detector and carbon monoxide detector device 200C. Device 200C may represent an alternate view of devices 100A, 100B, 200A, and 200B. Device 200C may include: cover grille 110, mesh 280, lens/button 120, light guide 281, button flexure 283, main chassis 210, diaphragm 284, passive infrared (PIR) and light emitting diode (LED) daughterboard 285, speaker 220, batteries 271, carbon monoxide (CO) sensor 286, buzzer 287, main circuit board 288, smoke chamber 260, chamber shield 289, enclosure 130, and surface mount plate 290. It should be understood that alternate embodiments of device 200C may include a greater number of components or fewer components than presented in FIG. 2C.

A brief description of the above-noted components that have yet to be described follows: Mesh 280 sits behind cover grille 110 to obscure external visibility of the underlying components of device 200C while allowing for airflow through mesh 280. Mesh 280 and grille 110 can help CO more readily enter the interior of the device, where CO sensor 286 is located. Light guide 281 serves to direct light generated by lights (e.g., LEDs such as the LEDs present on daughterboard 285) to the external environment of device 200C by reflecting off of a portion of cover grille 110. Button flexure 283 serves to allow a near-constant pressure to be placed by a user on various locations on lens/button 120 to cause actuation. Button flexure 283 may cause an actuation sensor located off-center from lens/button 120 to actuate in response to user-induced pressure on lens/button 120. Diaphragm 284 may help isolate the PIR sensor on daughterboard 285 from dust, bugs, and other matter that may affect performance. Daughterboard 285 may have multiple lights (e.g., LEDS) and a PIR (or other form of sensor). Daughterboard 285 may be in communication with components located on main circuit board 288. The PIR sensor or other form of sensor on daughterboard 285 may sense the external environment of device 200C through lens/button 120.

Buzzer 287, which may be activated to make noise in case of an emergency (and when testing emergency functionality), and carbon monoxide sensor 286 may be located on main circuit board 288. Main circuit board 288 may interface with one or more batteries 271, which serve as either the primary source of power for the device or as a backup source of power if another source, such as power received via a wire from the grid, is unavailable. Protruding through main circuit board may be smoke chamber 260, such that air (including smoke if present in the external environment) passing into enclosure 130 is likely to enter smoke chamber 260. Smoke chamber 260 may be capped by chamber shield 289, which may be conductive (e.g., metallic). Smoke chamber 260 may be encircled by a conductive (e.g., metallic) mesh (not pictured). Enclosure 130 may be attached and detached from surface mount plate 290. Surface mount plate 290 may be configured to be attached via one or more attachment mechanism (e.g., screws or nails) to a surface, such as a wall or ceiling, to remain in a fixed position. Enclosure 130 may be attached to surface mount plate 290 and rotated to a desired orientation (e.g., for aesthetic reasons). For instance, enclosure 130 may be rotated such that a side of enclosure 130 is parallel to an edge of where a wall meets the ceiling in the room in which device 200C is installed.

Figure 2D:
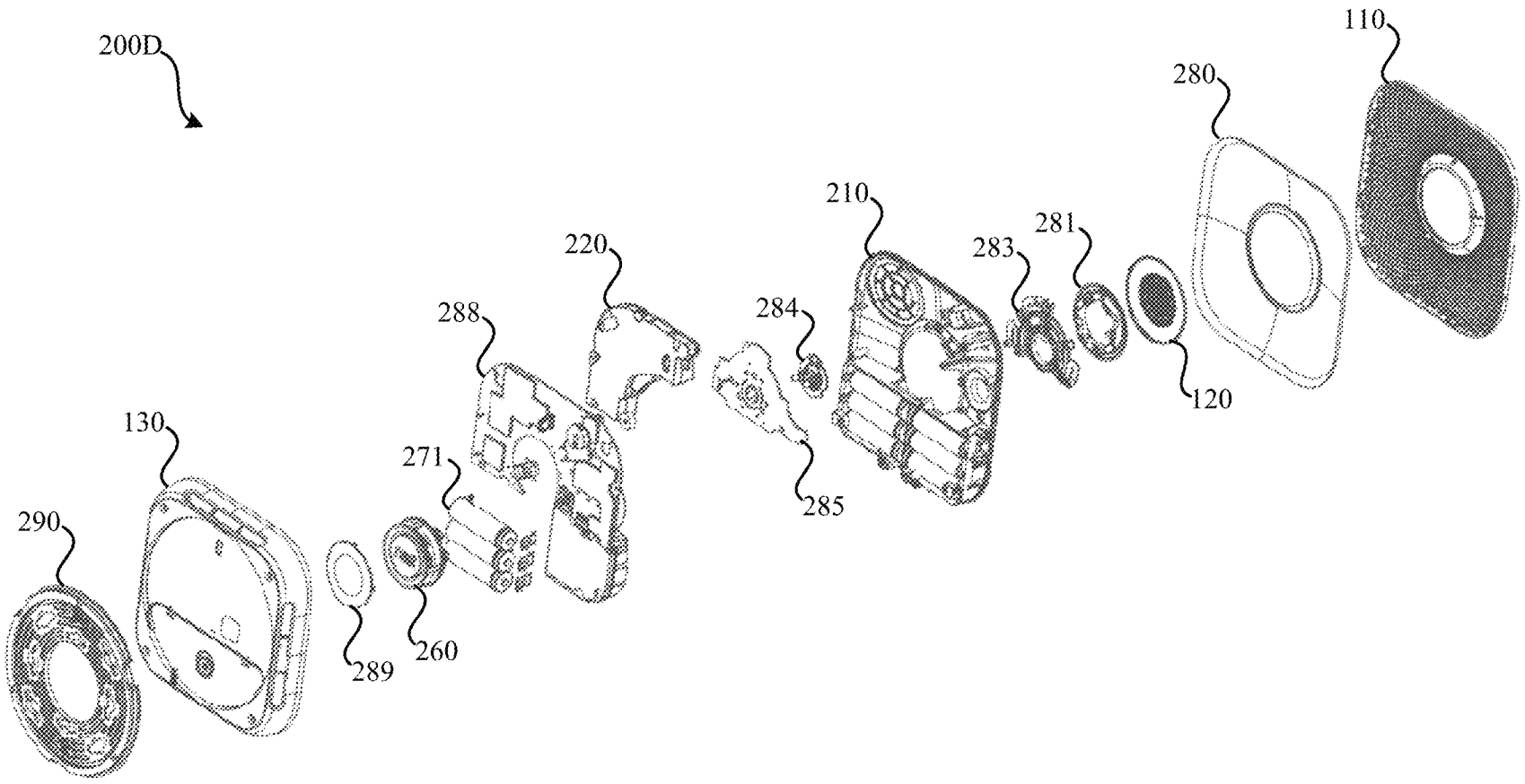

FIG. 2D represents the comprehensive exploded view of the smart combined smoke detector and carbon monoxide detector device of FIG. 2C viewed from a reverse angle as presented in FIG. 2C. Device 200D may represent an alternate view of devices 100A, 100B, 200A, 200B, and 200C. Device 200D may include: cover grille 110, mesh 280, lens/button 120, light guide 281, button flexure 283, main chassis 210, diaphragm 284, passive infrared (PIR) and light emitting diode (LED) daughterboard 285, batteries 271, speaker 220, carbon monoxide (CO) sensor 286, buzzer 287, main circuit board 288, smoke chamber 260, chamber shield 289, enclosure 130, and surface mount plate 290. It should be understood that alternate embodiments of device 200D may include a greater number of components or fewer components than presented in FIG. 2C.

Figure 3:
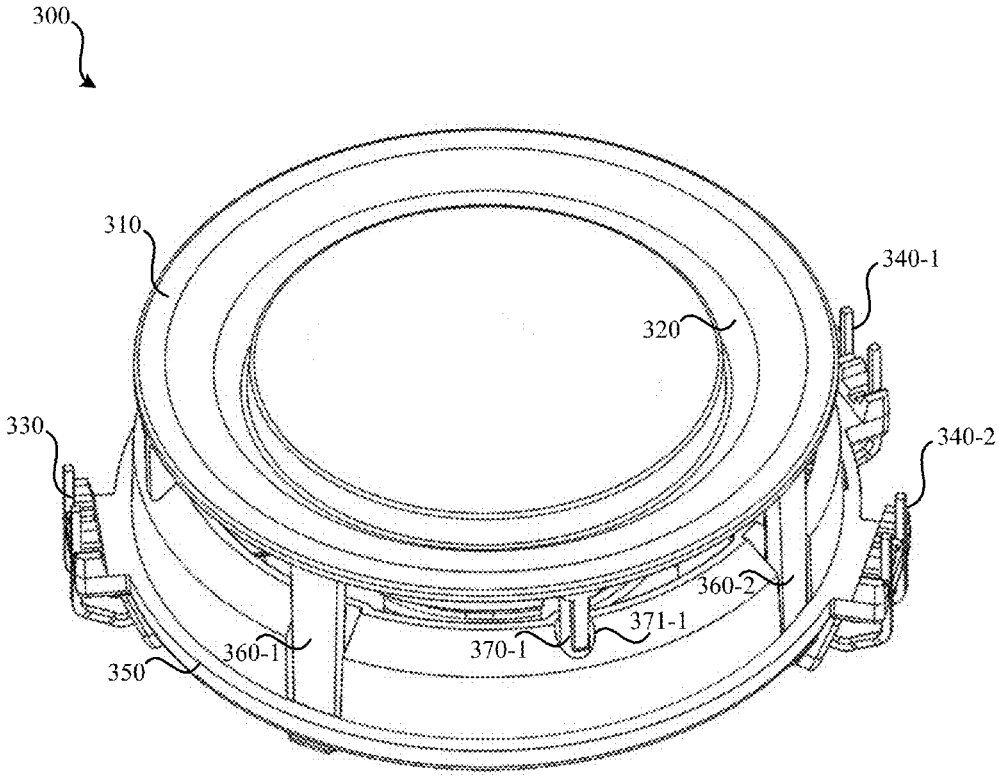
FIG. 3 illustrates an embodiment of a smoke chamber.

FIG. 3 illustrates an embodiment of a smoke chamber 300. Smoke chamber 300 can represent an embodiment of smoke chamber 260 of FIGS. 2B and 2C. As such, it should be understood that smoke chamber 300 can be incorporated into the devices detailed in relation to FIGS. 1A-2C or, alternatively, could be used in some other form of device that uses a smoke chamber, such as a dedicated optical smoke detector. To be clear, an "optical smoke detector" within this document refers to any form of smoke detector that uses emitted and sensed EM radiation to sense the presence of smoke. Smoke chamber 300 is generally circular when viewed from the top or bottom, and, in three dimensions, is generally cylindrical. Similarly, the airspace within smoke chamber 300 is generally cylindrical. Such a shape can be beneficial for a smoke chamber as it decreases the regions of the airspace (e.g., elimination of corners) in which airflow can stagnate within the smoke chamber. Smoke chamber 300 can include: top component 310, groove 320, bottom component 350, clips 360, rotational alignment extrusion 370-1, and rotational alignment gap 371-1. Coupled with smoke chamber 300 may be EM sensor 330 and EM emitters 340 (e.g., EM emitters 340-1, 340-2).

Smoke chamber 300 may include two components which form the housing that creates an airspace that is substantially isolated from exterior EM radiation. Smoke chamber 300 may include top component 310 and bottom component 350 which, following manufacturing of top component 310 and bottom component 350, are coupled together via attachment mechanisms. In some embodiments, the attachment mechanisms are clips, such as clips 360 (e.g., clips 360-1, 360-2, etc.). Clips 360 may be distributed around either top component 310 or bottom component 350. In some embodiments, four clips 360 are present; in other embodiments, fewer or greater numbers of clips 360 may be present. In the illustrated embodiment of FIG. 3, clips 360 are non-detachably attached to top component 310. When top component 310 is rotationally aligned with bottom component 350 and top component 310 and bottom component 350 are pushed together, clips 360 actuate and couple top component 310 with bottom component 350. In some embodiments, clips 360 are distributed every 90° around the perimeter of top component 310. Once coupled together via the clips, top component 310 and bottom component 350 may be separated again by pulling the two components apart or, in some embodiments, the clips are configured to permanently engage such that top component 310 and bottom component 350 cannot be separated (without damage).

In some embodiments, rotational alignment extrusion 370-1 is present. Rotational alignment extrusion 370-1 may be part of either top component 310 or bottom component 350. In the illustrated embodiment of smoke chamber 300, rotational alignment extrusion 370-1 is part of top component 310. Rotational alignment extrusion 370-1 may serve to ensure that, when top component 310 is coupled with bottom component 350, the two components are properly rotationally aligned. Rotational alignment extrusion 370-1 may, when properly aligned, insert into rotational alignment gap 371-1 which is present on bottom component 350. It should be understood that in other embodiments, rotational alignment gap 371-1 may be located on top component 310 and rotational alignment extrusion 370-1 may be located on bottom component 350. It is also possible that, in some embodiments, more than one rotational alignment extrusion and more than one rotational alignment gap may be present. If multiple rotation alignment extrusions are present, the shapes of such rotational alignment extrusions and corresponding rotational alignment gaps may be distinct such that a rotational alignment extrusion can only be inserted into a particular corresponding rotational alignment gap.

On top component 310, groove 320 may be present. Groove 320 may be present to decrease an amount of material necessary to mold top component 310. Top component 310 and bottom component 350 may each be molded out of plastic or some other material. As such, the less material used in making top component 310 and/or bottom 350, the less it may cost to manufacture smoke chamber 300.

Smoke chamber 300 may be designed such that EM sensor 330 senses EM radiation within an airspace present within smoke chamber 300. One or more EM emitters, such as EM emitters 340-1 and 340-2 may be positioned to emit EM radiation into the airspace within smoke chamber 300. EM emitters 340-1 and 340-2 may emit EM radiation at different wavelengths. For example, one of EM emitters 340 may emit infrared radiation while the other EM emitter may emit blue light. EM sensor 330 may only detect emitted EM radiation when particulate matter is present within smoke chamber 300 to deflect such emitted EM radiation into a field of view of EM sensor 330. While the illustrated embodiment of smoke chamber 300 uses two EM emitters, it should be understood that other embodiments of smoke chamber 300 may be configured for more than two EM emitters or a single EM emitter. Similarly, smoke chamber 300 is illustrated as having only a single EM sensor 330 partially inserted into smoke chamber 300. Other embodiments may use multiple EM sensors.

Greater detail regarding embodiments of top component 310 is provided in relation to FIGS. 4-7. Greater detail regarding embodiments of bottom component 350 is provided in relation to FIGS. 4, 5, and 8-11.

Figure 4:
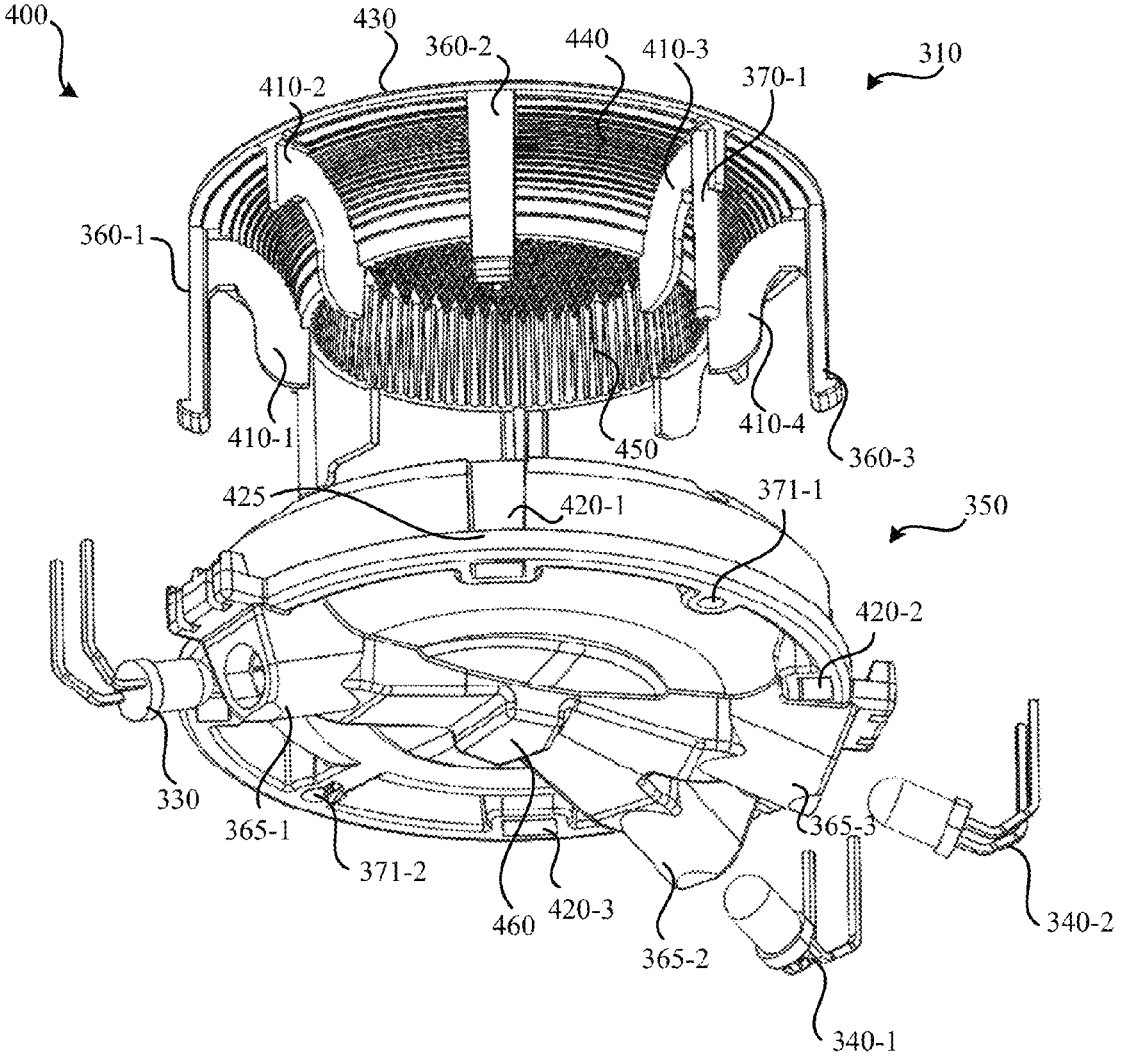
FIG. 4 illustrates an embodiment of the smoke chamber of FIG. 3 separated into constituent parts.

FIG. 4 illustrates smoke chamber 400 separated into constituent parts. It should be understood that smoke chamber 400 can represent smoke chamber 300 separated into its constituent parts and/or can represent any other smoke chamber discussed in this document. Smoke chamber 400 is decoupled into its constituent parts: top component 310 and bottom component 350. Also illustrated in embodiment 400 are EM emitters 340 and EM sensor 330. As detailed in relation to FIG. 3, clips 360 are permanently part of top component 310. Clips 360-1 may be configured to detachably or non-detachably couple with bottom component 350 when inserted into clip channels 420 (e.g., clips channels 420-1, 420-2, 420-3, etc.). When inserted into clip channels 420, clips 360 may clip to a portion of clip lip 425. It should be understood that a clip channel may be present for each clip of clips 360 present on top component 310.

Present on top component 310 may be airflow fins 410. Airflow fins may serve to channel airflow towards the center of the airspace within smoke chamber 400. Each of airflow fins 410 may be radially aligned with a center point or center axis (center axis 500 of FIG. 5B) of top component 310 (or, more generally, smoke chamber 400). Airflow fins 410 may be located along an airflow surface 430 of top component 310. Each airflow fin of airflow fins 410 may be curved to follow airflow surface 430 and the resulting airflow path that leads from the external environment to the airspace within smoke chamber 400. Airflow fins 410 may be distributed at regular intervals around the curved airflow surface 430. The curved airflow surface 430 may radially curve outward from the center or center axis of top component 310. The outer perimeter of airflow surface 430 may be circular, each airflow fin may be evenly distributed on airflow surface and radially aligned with a center axis of top component 310. Airflow fins 410 may be sized such that, when top component 310 is coupled with bottom component 350, airflow fins 410 occupy the full height of an airflow channel between the airspace within smoke chamber 400 and the external environment.

In some embodiments, eight airflow fins are present and are equally distributed at 45° angles as measured from a center axis of top component 310. In other embodiments, a greater or fewer number of airflow fins may be present. In the illustrated embodiment, airflow fins are either free standing (e.g., airflow fin 410-2) and molded to top component 310, molded to a clip (e.g., airflow fin 410-1 partially molded to clip 360-1) and molded to top component 310, or molded to a rotational alignment extrusion (e.g., airflow fin 410-3 partially molded to clip 360-3) and molded to top component 310. As such, rotational alignment extrusion 370-1 may be positioned at a 45° angle on top component 310 relative to clips 360.

On airflow surface 430, which is generally curved, a series of steps 440 set at 90° angles or approximately 90° angles to each other may be present. Such steps may be circular in that they are concentrically arranged around a central axis of top component 310 (central axis 599 of FIG. 5B). Steps 440 may be interrupted at the locations where airflow fins 410, clips 360, and/or rotational alignment extrusion 370-1 are molded to top component 310. Steps 440 vary in height and depth such as to mirror the radially-outward curve of airflow surface 430. Circular steps 440 may serve to help prevent light from the external environment from being reflected off of airflow surface 430 into the airspace of smoke chamber 400. In some embodiments, at least ten steps are present; in other embodiments, twelve, fifteen, or some smaller or greater number of steps are present.

Encircling the airspace within smoke chamber 400 may be airspace ribs 450. Airspace ribs may completely encircle the portion of the airspace housed by top component 310. Airspace ribs 450 may serve to obscure reflection of EM radiation incident on such airspace ribs 450 by helping to prevent such EM radiation from being reflected back into the airspace and, more specifically, toward EM sensor 330. Airspace ribs may be triangular in that each rib includes two flat sides that meet at an angle (the third side being part of a curved wall that forms the airspace).

Referring now to bottom component 350, clip lip 425 may at least partially encircle bottom component 350. Clip lip 425 may, in some embodiments, only be present in the vicinity of clip channels 420 to allow clips 360 to couple with bottom component 350. Referring to the rotational alignment gaps, rotational alignment gap 371-1 has a different perimeter than rotational alignment gap 371-2 such as to correspond to a particular rotational alignment extrusion of top component 310.

EM sensor 330 and EM emitters 340 may be partially inserted into bottom component 350. Anchor bay 365-1 may receive EM sensor 330 and allow it to sense EM radiation within the airspace of smoke chamber 400. Anchor bay 365-2 may receive EM emitter 340-1 and allow it to emit EM radiation into the airspace of smoke chamber 400. Anchor bay 365-3 may receive EM emitter 340-2 and allow it to emit EM radiation into the airspace of smoke chamber 400. Anchor bays 365 may be sized such that EM sensor 330 and EM emitters 340 fit tightly to limit EM leakage of EM radiation into or out of the airspace of smoke chamber 400 between an edge of anchor bays 365 and EM sensor 330 and EM emitters 340.

Present at and around a center point of bottom component 350 may be dust collector 460. Dust collector 460 may be positioned directly below a center point of where the emitted EM radiation from EM emitters 340 intersects the field of view of EM sensor 330. Dust collector 460 may be a depressed portion of bottom component 350. Dust collector 460 may be below a field of view of the EM sensor. In some embodiments, dust collector 460 may be a pentagonal shape; in other embodiments, other shapes, such as a circular shape, may be used. Dust collector 460 may serve to collect any small particles that have entered smoke chamber 400 and have settled (i.e. are no longer suspended in air). Dust collector 460 may help prevent such particles from interfering with or causing a false positive of smoke detection by deflecting EM radiation emitted by EM emitters 340.

Figure 5A:
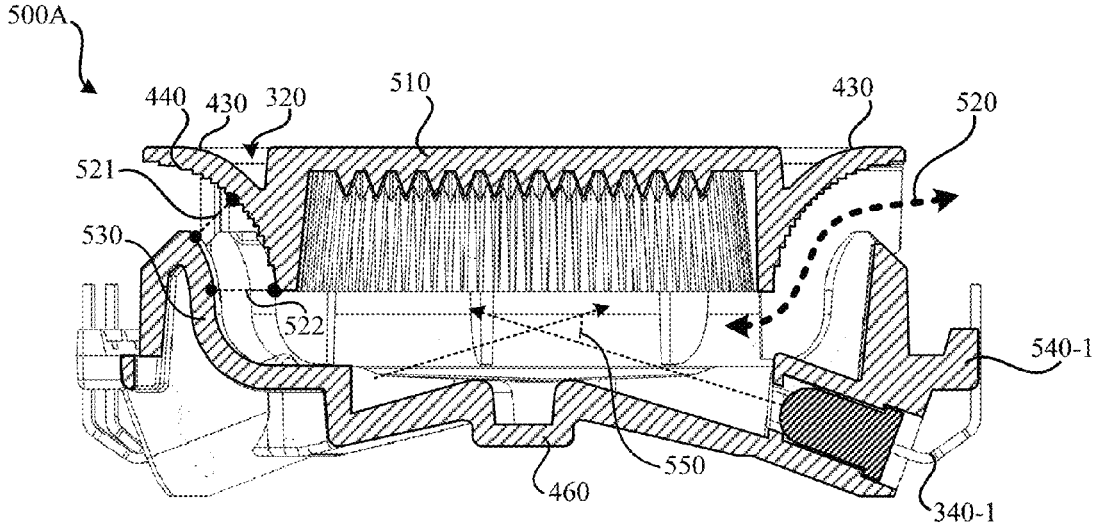
FIGS. 5A and 5B illustrate a cross section of an embodiment of the smoke chamber of FIG. 3.
Figure 5B:
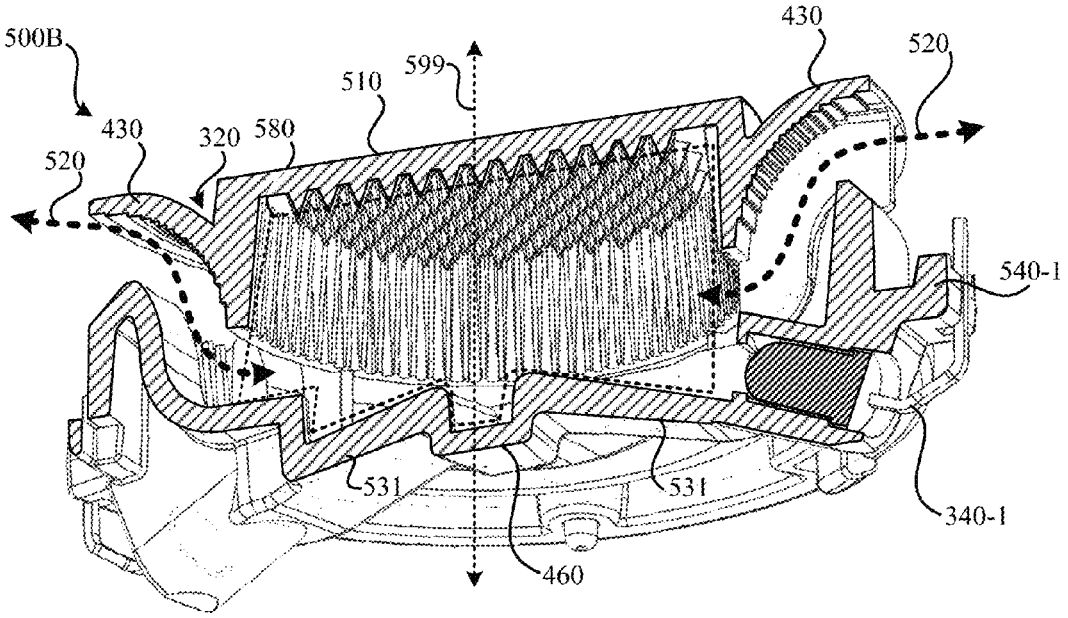

FIGS. 5A and 5B illustrate a cross section of an embodiment of the smoke chamber of FIGS. 3 and 4. The embodiments of smoke chambers 500A and 500B, which represent cross sections of the previously detailed smoke chambers 300 and 400, are discussed in parallel below. The features discussed in relation to smoke chambers 500A and 500B may be present in any of the detailed smoke chambers within this document. Smoke chambers 500A and 500B are shown with the top component and bottom component coupled. The three-dimensional airspace 580, loosely outlined in FIG. 5B, represents the airspace present within smoke chambers 500A and 500B.

Top platter 510 serves as the ceiling of smoke chambers 500A/500B. The exterior surface of top platter 510 may generally be flat. This allows a flat metallic cap to be placed against top platter 510 to help isolate all EM sensors from external EM radiation. The radial outward curve of airflow surface 430 is readily available in the cross-section of FIG. 5A. Further, as can be seen, steps 440 are located upon the surface of airflow surface 430. Also clearly visible is groove 320 which encircles top platter 510. Airflow path 520 for airflow into and out of airspace 580 is represented by a dotted arrow. It should be understood that this path for airflow generally encircles airspace 580. The path for airflow may be interrupted by structures such as clips 360, airflow fins 410, and rotational alignment extrusions 370.

In order to maintain a high level of airflow, a minimum width for the airflow path may be maintained between airflow surface 430 and airflow surface 530. For instance, the minimum height of the airflow channel may be 3 mm. Therefore, at locations such as 521 and 522, the distance between airflow surface 430 and airflow surface 530 may be at least 3 mm. In other embodiments, a smaller or greater minimum distance between the two airflow services may be maintained. Further, airflow surfaces 430 and 530 are positioned relative to each other such that a direct path does not exist for light from the external environment to enter airspace 580 (or, if it does exist, allows for very little light to enter the airspace).

While airflow surface 430 is covered in a series of steps 440, airflow surface 530 may not be covered in such steps. This may allow stray EM radiation from within airspace 580 to more readily be reflected off airflow surface 530 out of airspace 580. Therefore, while the step surface of airflow surface 430 is intended to prevent EM radiation from entering smoke chamber 500, airflow surface 530 may be curved to promote EM radiation to reflect off the surface of airflow surface 530 and exit smoke chamber 500A/500B. In some embodiments, airflow surface 530 is polished to promote reflection out of the smoke chamber.

In some embodiments, at least a portion of airflow surface 530 and interior surface 531 is polished. By having these surfaces polished, reflections on such surfaces may be more predictable and can more consistently be handled, thus, helping to limit false positive detections of smoke.

Offset angle 550 represents an offset angle between an emission path of emitter 340-1 and the field of view of the EM sensor. It may be desirable for such an offset angle to be present such that each EM emitter of EM emitters 340 does not directly emit EM radiation into a field of view of the EM sensor. Rather, EM radiation needs to be deflected off particulate matter, such as smoke, in order to be sensed by an EM sensor. The offset angle can affect performance of when smoke is detected within smoke chamber 500A/500B. In some embodiments, offset angle 550 between the EM emitters and the EM sensor is 40°. In such embodiments, the EM emitters are symmetrically offset at an from the EM sensor. At such an offset angle, a large amount of discrimination between particle sizes less than 300 nanometers may be attained. Within a range of approximately 35° to 45° has been found to be effective for forward scatter sensing of smoke particulate matter.

The bottom component of smoke chamber 500*a* may have emitter/sensor holders, such as emitter/sensor holder 540-1. Emitter/sensor holder 540-1 may serve to hold and anchor one or more leads of an EM sensor or EM emitter, such as EM emitter 340-1. Emitter/sensor holder 540-1 may serve to help hold EM emitter 340-1 in place such that EM emitter 340-1 remains properly inserted within its anchor bay. Emitter/sensor holders 540 may have gaps that receive leads of EM sensors and emitters. Once inserted, friction and/or the emitter/sensor holder partially deforming, may help hold the sensor/emitter in place.

Further, in FIG. 5B, central axis 599 is represented. This axis represents the center of the top and bottom components. Various components of both the top and bottom components are arranged in concentric patterns about central axis 599.

Figure 6:
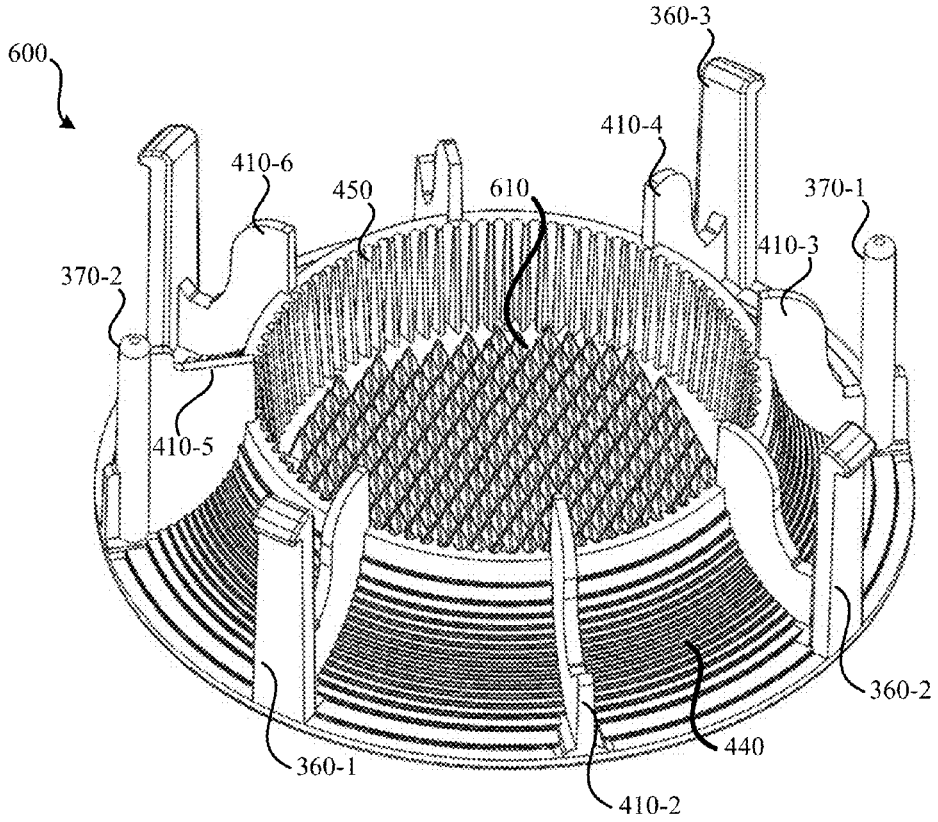
FIG. 6 illustrates an angular projection of an embodiment of a top component of the smoke chamber.

FIG. 6 illustrates an angular projection of an embodiment of a top component 600 of the smoke chamber. Top component 600 is shown inverted in FIG. 6. Top component 600 may represent any of the previously detailed top components of the various detailed smoke chambers or any other top component discussed in this document. Visible in top component 600 are pyramidal extrusions 610. Pyramidal extrusions 610 may serve to limit reflection of EM radiation incident on the internal top surface of top component 600. Pyramidal extrusions 610 may have three or four sided extrusions. Pyramidal extrusions 610 may be arranged in roughly a circular pattern around a center point of top component 600. Dozens or hundreds of pyramidal extrusions 610 may be present. Pyramidal extrusions 610 may be molded as part of top component 600 (as may all other components of top component 600). While the extrusions are pyramidal in the illustrated embodiment of FIG. 6, it should be understood that the extrusions may be in some other shape (e.g., conical) and serve a similar purpose of limiting reflected EM radiation.

On the opposite side of top component 600 from rotational alignment extrusions 370-1 is a second extrusion referred to as rotational alignment extrusions 370-2. In some embodiments, rotational alignment extrusion 370-2 is at a 180° angle to rotational alignment extrusion 370-1 around top component 600. Rotational alignment extrusion 370-2 may be a length different from rotational alignment extrusion 370-1 in order to couple with a different sized rotational alignment gap of a corresponding bottom component. Additionally or alternatively, and as illustrated in FIG. 6, rotational alignment extrusion 370-2 is attached to a differently shaped airflow fin 410-5. Airflow fin 410-5, rather than mirroring the shape of the airflow path created by the airflow surface of the corresponding bottom component, instead forms a fin to be inserted through a slot at a corresponding location in a bottom component. As such, for top component 600 to be clipped to a corresponding bottom component, at least rotational alignment extrusion 370-1, rotational alignment extrusion 370-2, and airflow fin 410-5 need to be properly rotationally aligned with the corresponding bottom component.

Figure 7:
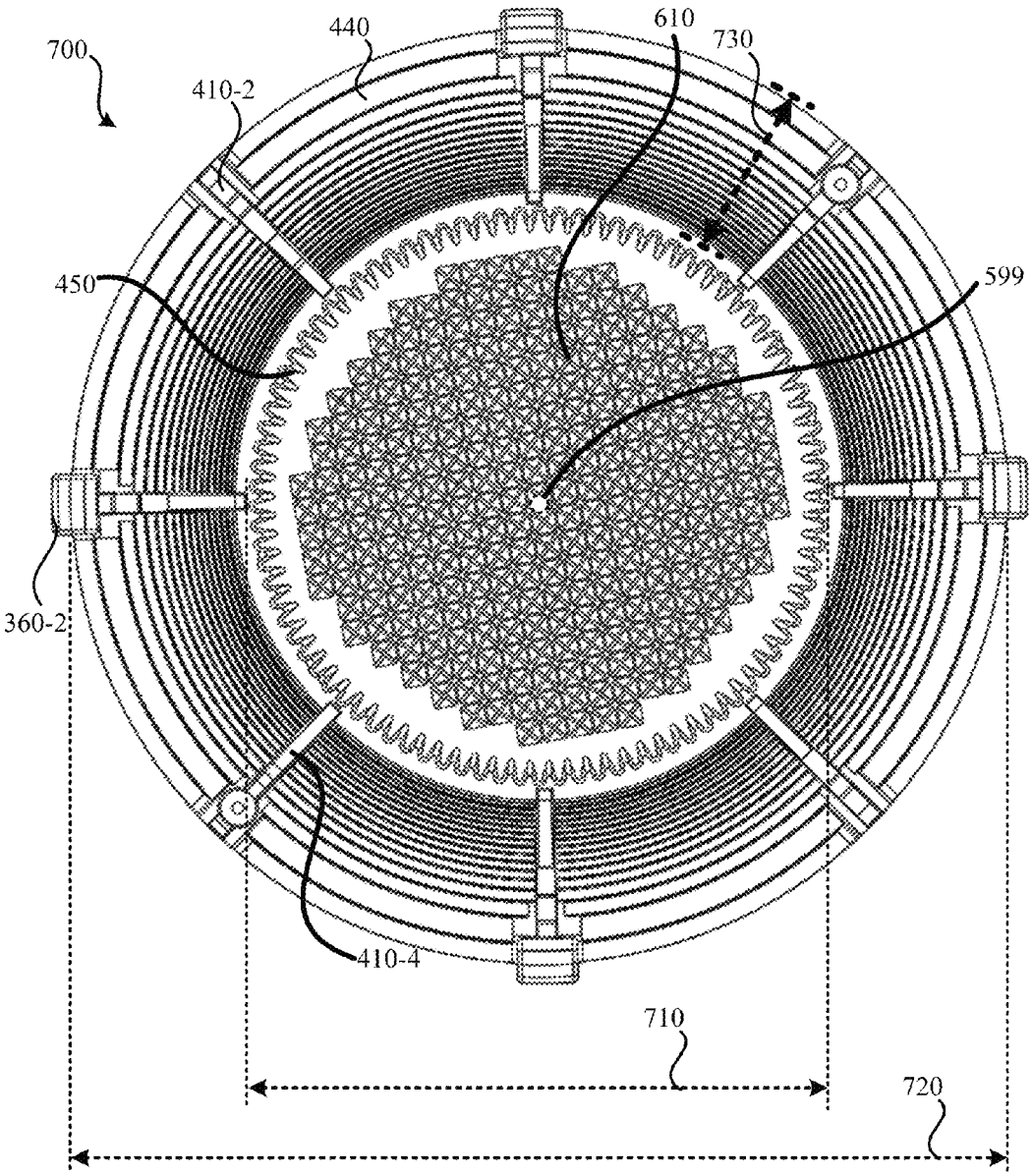
FIG. 7 illustrates a bottom view of an embodiment of a top component of the smoke chamber.

FIG. 7 illustrates a bottom view of an embodiment of a top component 700 of the smoke chamber. Top component 700 is illustrated inverted. Top component 700 may represent any of the previously detailed top components of the various detailed smoke chambers or the top chamber of any other smoke chamber detailed in this document. Visible in top component 700 are pyramidal extrusions 610. In the illustrated embodiment, pyramidal extrusions 610 are arranged in rows and columns that are angularly offset from being aligned with any airflow fin, such as airflow fin 410-4. In other embodiments, pyramidal extrusions 610 may be aligned with one or more airflow fin.

Steps 440 are visible as encircling the airflow surface of top component 600. Steps 440 form concentric circles around a center axis of top component 600 along the airflow surface, steps 440 being interrupted by airflow fins 410 (e.g., 410-4), clips 360, and rotational alignment extrusions 370.

In the illustrated view of top component 700, airspace ribs 450 can be seen as fully encircling the airspace formed by the interior of top component 700. Airspace ribs 450 may be parallel and concentric around the central axis (e.g., central axis 599) of top component 700. In other embodiments, airspace ribs may not be parallel with the central axis and/or may not fully encircle the airspace formed by the interior of top component 700.

Figure 8:
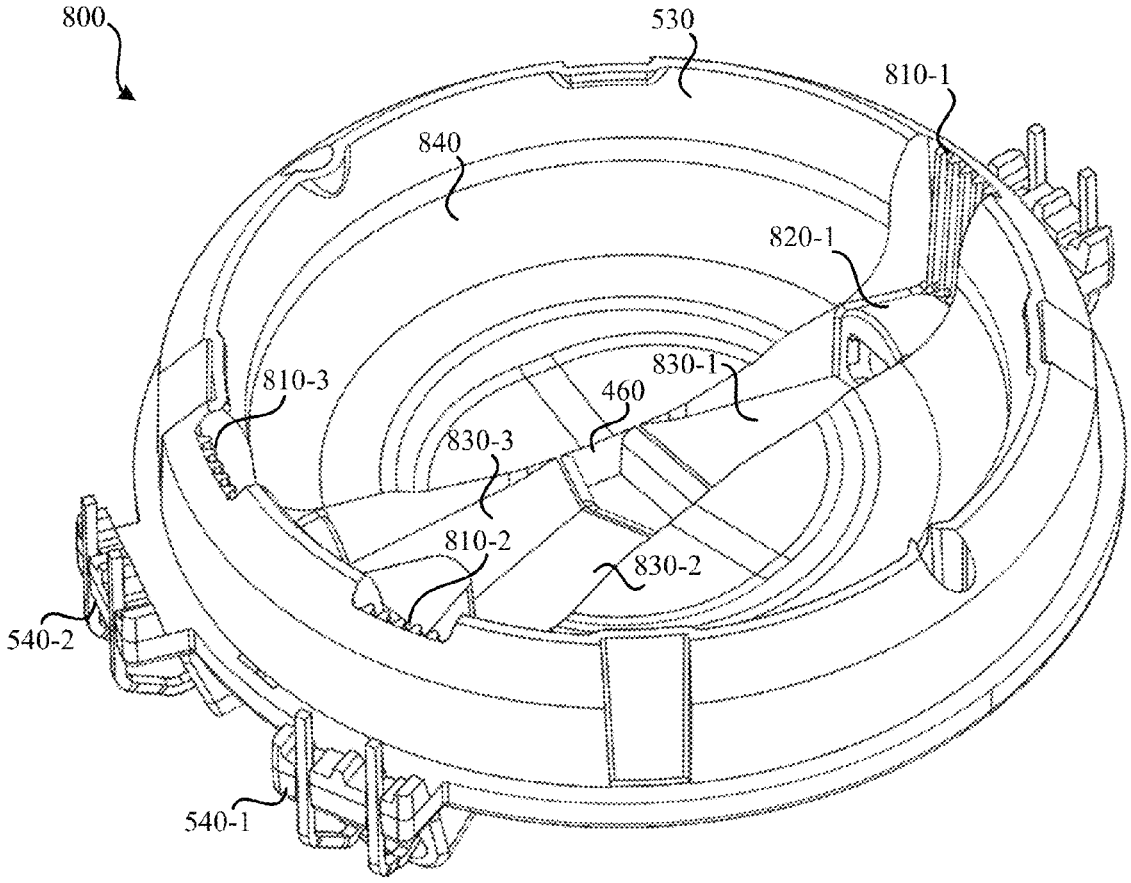
FIG. 8 illustrates an angular projection of an embodiment of the bottom component of the smoke chamber.

FIG. 8 illustrates an angular projection of an embodiment of the bottom component 800 of the smoke chamber. Bottom component 800 may represent any of the previously detailed bottom components of the various detailed smoke chambers or any other bottom component detailed in this document. Visible in bottom component 800, as illustrated, are bay rib regions 810 (e.g., bay rib regions 810-1, 810-2, 810-3). Bay rib regions 810 may only be located above anchor bays 820, of which in the illustration of FIG. 8 only anchor bay 820-1 is visible. An anchor bay of anchor bays 820 are where EM emitters and EM sensors are inserted in order to emit or sense EM radiation within the airspace of the smoke chamber formed by bottom component 800. Bay ribs of bay ribs regions 810 may serve to prevent reflection of EM radiation incident upon them. Bay ribs of bay ribs regions 810 may be parallel to a central axis of bottom component 800, such as central axis 599 of FIG. 5B. In other embodiments, Bay ribs of bay ribs regions 810 may not be parallel to such a central axis. Bay ribs of bay ribs regions 810 may be present as opposed to a smooth, polished surface (e.g., 530) due to constraints of the manufacturing process. As with the various detailed top components, the various detailed bottom components, including bottom component 800, may be molded as a single piece of material, such as (polycarbonate) plastic.

Depressed within the bottom internal surface of bottom component 800 may be bottom channels 830. A stand-alone bottom channel 830-1 may be present for the EM sensor (which is to be inserted in anchor bay 820-1). Bottom channels 830-2 and 830-3 may meet and merge away from the anchor bays for the EM emitters. Bottom channels 830 may be depressed so as to decrease a likelihood that a buildup of particulate matter (e.g., dust) affects sensing of EM radiation within the smoke chamber. The surface of bottom channels 830 may be polished. Each of bottom channels 830 may be directed from its respective anchor bay toward the central axis of bottom component 800. Bottom channels 830 may end and meet at dust collector 460. Internal surface 840, like airflow surface 530, may be smooth and polished. Embodiments are possible in which internal surface 840 may be rough to obscure reflections.

Figure 9:
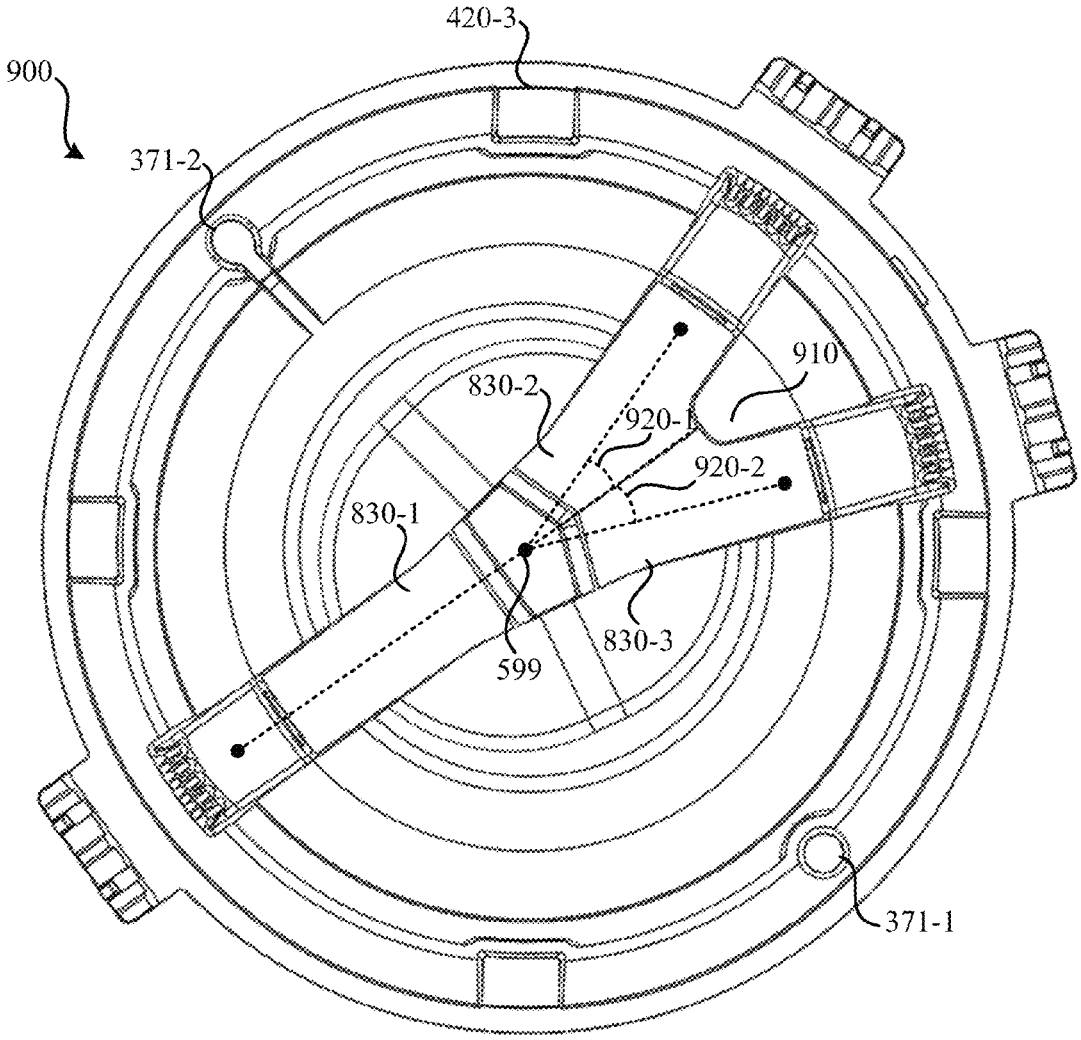
FIG. 9 illustrates a top view of an embodiment of the bottom component of the smoke chamber.

FIG. 9 illustrates a top view of an embodiment of the bottom component 900 of the smoke chamber. Bottom component 900 may represent any of the previously detailed bottom components of the various detailed smoke chambers. Visible in FIG. 9 are rotational alignment gaps 371. Rotational alignment gap 371-1 is configured to receive an extrusion, while rotational alignment gap 371-2 is configured to receive a rotational alignment extrusion and elongated fin. Such rotational alignment gaps allow bottom component 900 to be coupled with a top component in one particular rotational alignment. Also visible in bottom component 900 are bottom channels 830. In the illustrated embodiment of bottom component 900, two bottom channels for EM emitters are present and a single channel for an EM sensor is present. EM channels 830-2 and 830-3 are aimed towards a center axis of bottom component 900. Wedge isolator 910 is a piece of material (e.g., part of the molded bottom component 900) that helps isolate the two EM emitter anchor bays from each other. Just as a vertical offset angle 550 was discussed in relation to FIG. 5A, a horizontal offset angle may be present between the two emitter anchor bays. Horizontal offset angles 920 (920-1, 920-2) are in a plane perpendicular to central axis 599. In some embodiments, each of these angles is 20 degrees. Offset angles 920 may be the same or may be different angles. Various embodiments may have any angle between 10 and 35 degrees for each of offset angles 920. The angles of 920-1 and 920-2 may vary from each other.

Figure 10:
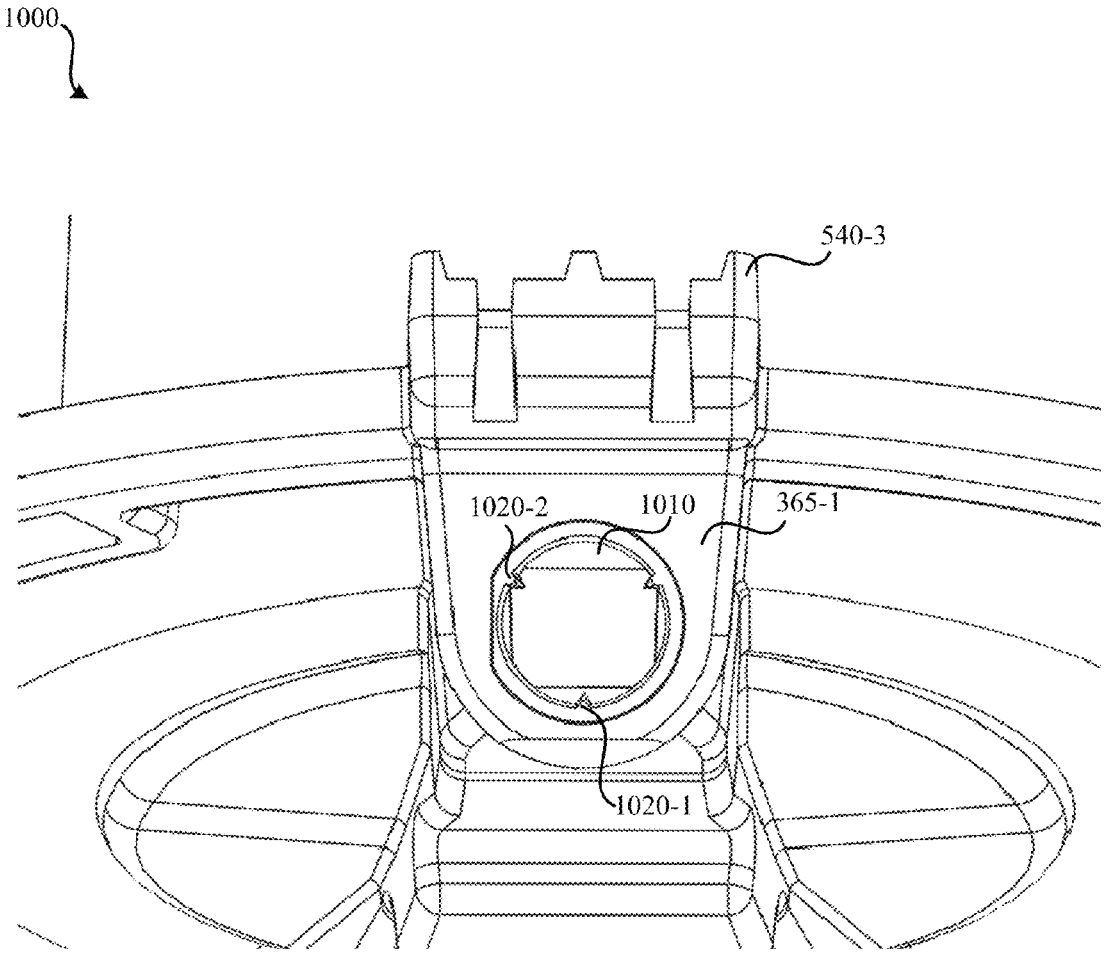
FIG. 10 illustrates a side view of an embodiment of the bottom component of the smoke chamber.
Figure 11:
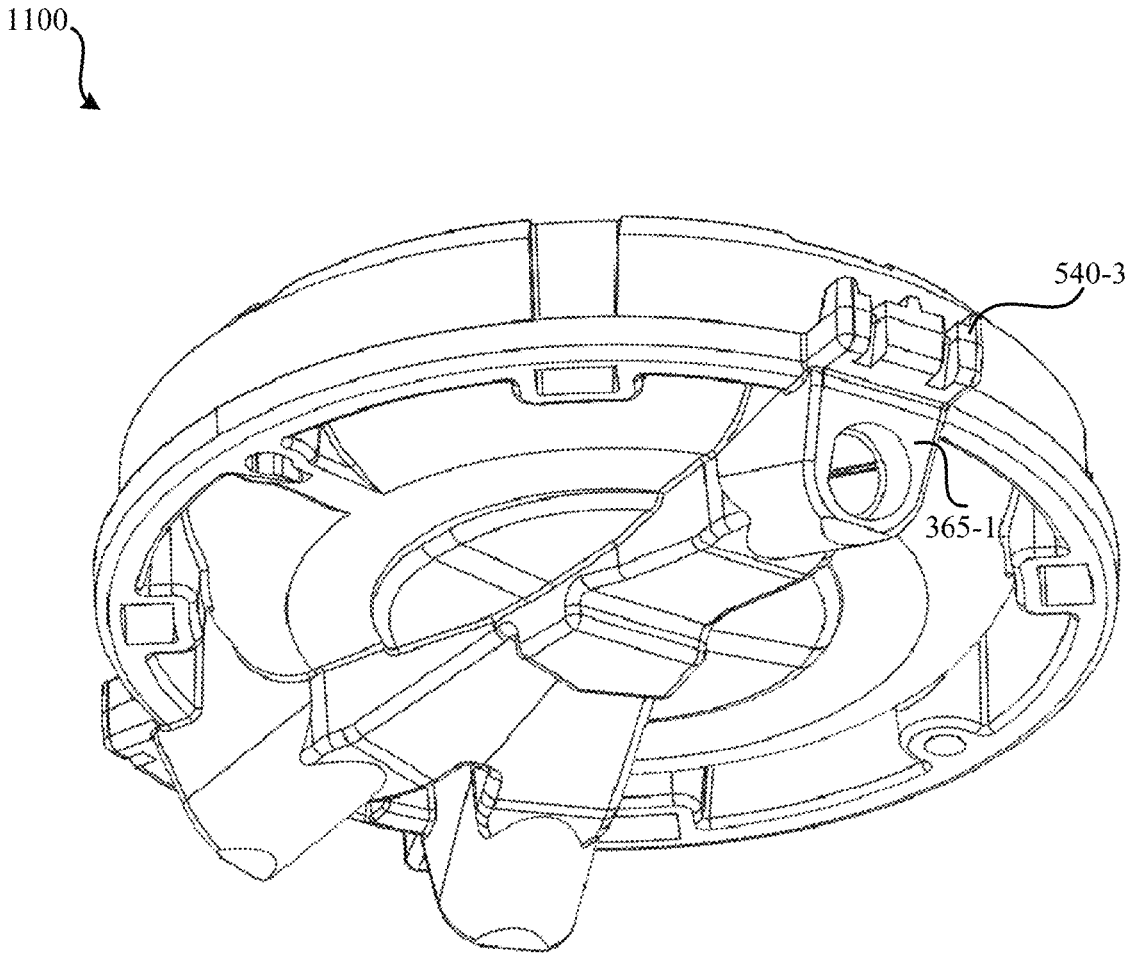
FIG. 11 illustrates another angular projection of an embodiment of the bottom component of the smoke chamber.

FIG. 10 illustrates a side view of an embodiment of the bottom component 100 of the smoke chamber. Bottom component 1000 may represent any of the previously detailed bottom components of the various detailed smoke chambers. FIG. 11 illustrates an angular view of an embodiment of the bottom component 1100 of the smoke chamber. Bottom component 1100 may represent any of the previously detailed bottom components of the various detailed smoke chambers. Bottom components 1000 and 1100 are described together as follows. Emitter/sensor holder 540-3 serves to hold an EM sensor in place such that the sensor's field of view is through aperture 1010 and therefore has a view of the airspace within the smoke chamber formed using bottom component 1000. Aperture 1010 is rectangular in shape within the circular opening of anchor bay 365-1. Aperture 1010 may be adjusted in height and width to control the field of view of the EM emitter inserted within the circular opening of anchor bay 365-1. While the illustrated embodiment is focused on an EM sensor, a similar aperture may be present for one or more of the anchor bays for EM emitters. Each EM emitter anchor bay may have a same aperture as 1010, may have an aperture specific to the EM emitters, or may have an aperture selected for the specific wavelength of the EM radiation emitted by the particular EM emitter (that is, the aperture used for each EM emitter may vary). In other embodiments, the apertures and/or the aperture for either or both of the EM emitters may be another shape, such as circular, square, oval, etc.

Also present within anchor bay 365-1 may be crush ribs 1020 (e.g., crush rib 1020-1, 1020-2). Crush ribs 1020 may help secure an inserted EM sensor within the opening of anchor bay 365-1. When an EM sensor is inserted into the circular opening, crush ribs 1020 may be partially deformed and may exert pressure and cause friction on the EM sensor. Therefore, emitter/sensor holder 540-3 and crush ribs 1020 may function in concert to hold an EM sensor in place. It should be understood that other anchor bays 365 (e.g., for EM emitters) may have similar arrangements of crush ribs. In the illustrated embodiment, three crush ribs 1020 are equally distributed at 120 degree angles around the circular opening of anchor bay 365-1; it should be understood that in other embodiments, fewer or greater numbers of crush ribs 1020 may be used for securing the EM sensor.

Figure 12A:
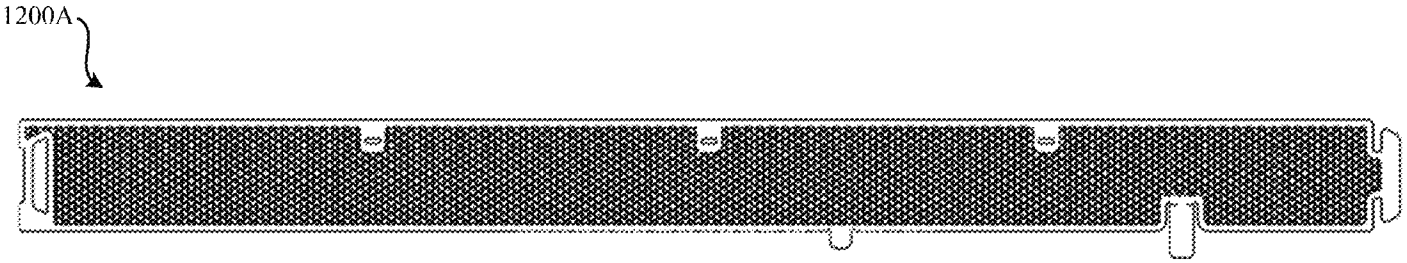
FIGS. 12A-12C illustrate an embodiment of a mesh that can be wrapped around the various detailed embodiments of smoke chambers to help filter large particulate matter.

FIG. 12A illustrates an embodiment of a mesh 1200A that can be wrapped around the various detailed embodiments of smoke chambers to prevent large particulate matter (e.g., bugs, dust) from entering the smoke chamber. Such large particulate matter, if in the smoke chamber, may result in a false detection of smoke, leading to an alarm being sounded when no smoke or fire is present. Referring to FIGS. 5A and 5B, mesh 1200A may be wrapped around smoke chambers 500A/500B such that airflow path 520 is fully encircled by mesh 1200A. As such, all airflow entering (and exiting) interior 580 passes through mesh 1200A. Chamber shield may include one or more solder tabs to allow mesh 1200A to be attached by solder to a circuit board.

Figure 12B:
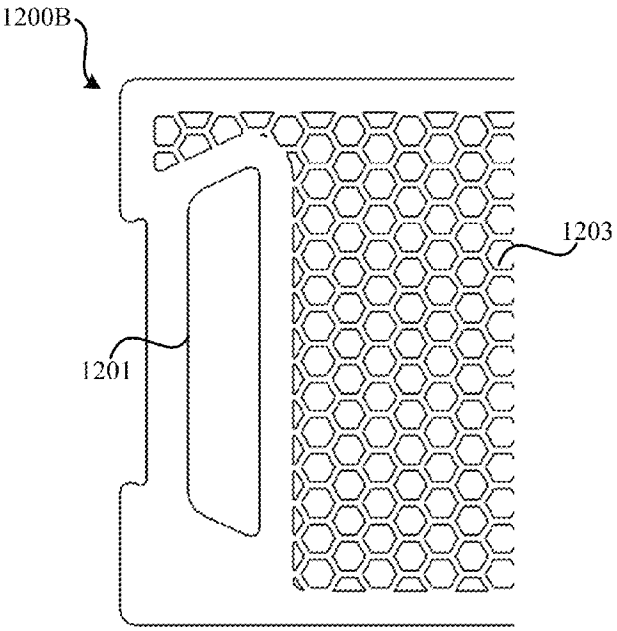
Figure 12C:
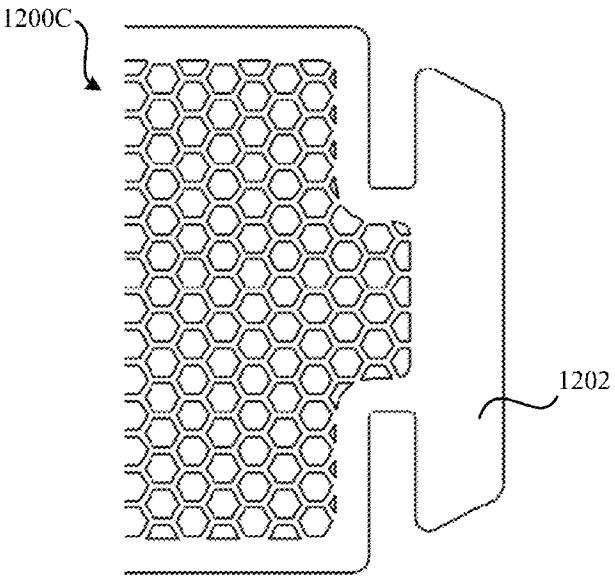

Mesh 1200A may be conductive. More specifically mesh 1200A may be metallic. Mesh 1200A is further represented by first mesh end 1200B of FIG. 12B and second mesh end 1200C of FIG. 12C. First mesh end 1200B (which represents the left end of mesh 1200A) contains tab joint 1201 which is configured to receive tab 1202 of second mesh end 1200C (which represents the right end of mesh 1200A) when mesh 1200A is wrapped around a smoke chamber. While tab 1202 and tab joint 1201 represent one possible embodiment of how the ends of mesh 1200A can be joined together, it should be understood that other attachment methods and/or mechanisms can be used (e.g., glue, clips, etc.). Present on mesh 1200A and visible on first mesh end 1200B and second mesh end 1200C is a hexagonal mesh pattern 1203 that allows substantial airflow through mesh 1200A. Each hexagonal mesh hole may be between 0.1 mm and 2 mm in average width. It should be understood that other mesh patterns are possible, including circular mesh patterns, rectangular mesh patterns, etc.

Mesh 1200A may function in concert with chamber shield 289, which can serve as a conductive (e.g., metallic) cap over the smoke chamber. A conductive base, which may be a field of solder present on an underlying circuit board or a conductive barrier similar to chamber shield 289, may be present on the opposite side of a smoke chamber such that the smoke chamber is surrounded by a conductive barrier. This conductive barrier, which serves as a Faraday cage, can serve to decrease an amount of EM noise (generated by external sources) sensed by the EM sensor present within the smoke chamber. Mesh 1200A may be manufactured as a single piece of metal that includes a chamber shield 289. A tab may be bent such to allow chamber shield 289 to be placed atop a smoke chamber.

In some embodiments, mesh 1200A is connected with chamber shield 289 by the two components being formed from a single piece of metal and connected via tab 1205. Chamber shield 289 may be folded over the top of a smoke chamber while the remainder of the mesh 1200A is wrapped around the smoke chamber. In some embodiments, on the opposite side of the smoke chamber from chamber shield 289, the smoke chamber may not be fully encased in a conductive shield. Rather, only a portion of the smoke chamber proximate to the location of the EM sensor may be wrapped in a conductive material. Such an arrangement may decrease the total amount of conductive material that needs to be used to effectively provide a Faraday cage around the EM sensor.

Different types of fires can produce particulate matter of different sizes. For instance, a highly energetic flaming fire may tend to produce smaller smoke particles while a less energetic, smoldering fire may tend to produce larger smoke particles. It is important for a smoke detector to be able to detect all of such types of fires early enough (e.g., to allow persons to escape the situation, protect private property from burning). To be able to do so effectively, using multiple wavelengths of light within a smoke chamber may be beneficial. That is, certain wavelengths of light may work better for detecting particulate matter of certain size ranges, as the closer match between wavelength and mean particle size can result in higher scattering efficiency. For instance, infrared light may work well for large smoke particles while blue light may work well for smaller smoke particles.

Inside a smoke chamber there can be a large number of smoke particles, encompassing a multitude of shapes, compositions, and sizes. Therefore, density distributions can be used to model the size, shape, and permittivity of the particulate matter. The shape and permittivity of the smoke chamber itself, as well as the spectral characteristics of the EM emitter(s) and EM sensor (e.g. photodetector), all play a role in how much reflected or deflected EM radiation can be detected by the EM sensor.

In general, smoke produced by a specific material (e.g., liquid fuel, paper, cotton, wood) has a characteristic density distribution. The presence of flames (flaming fires) or lack thereof (smoldering fires) and the environmental conditions (e.g., humidity, temperature) have a direct influence on the thermodynamic environment of the event and can affect the transport of smoke particulate matter. At one extreme, smoke can be very energetic and quickly propagate through an environment and find its way to a smoke detector device quickly. On the other end of the spectrum, some smoldering fires can produce large quantities of low energy smoke that stratifies near or several feet above a floor of a room and a significant amount of time can elapse before enough smoke particles propagate far enough to reach the smoke detector.

By using multiple wavelengths of EM radiation to detect smoke particles, it can become possible (up to a point) to differentiate between different kinds of fires by creating incident fields centered at specific wavelengths. For instance, using EM radiation at significantly different wavelengths (e.g., wavelengths near the opposite ends of the visible light spectrum, such as blue and infrared EM radiation), it may be possible to identify the type of fire causing the smoke.

The smoke chambers, along with the EM emitters and EM sensors, previously detailed can be used to perform various methods of smoke detection. Various methods may involve using multiple EM emitters in combination with an EM sensor and an embodiment of a smoke chamber as previously detailed in relation to FIGS. 3-12. Referring to FIG. 2C, device 200C may perform the methods of FIGS. 13-16. Other forms of devices, such as a dedicated smoke detector having a smoke chamber, may perform the methods of FIGS. 13-16. As detailed in relation to FIG. 17, a system that includes a smoke chamber, two (or more) EM emitters, an EM sensor, and a processing system may perform the methods of FIGS. 13-16. In some embodiments, system 1700 of FIG. 17 may be part of device 200C.

Figure 13:
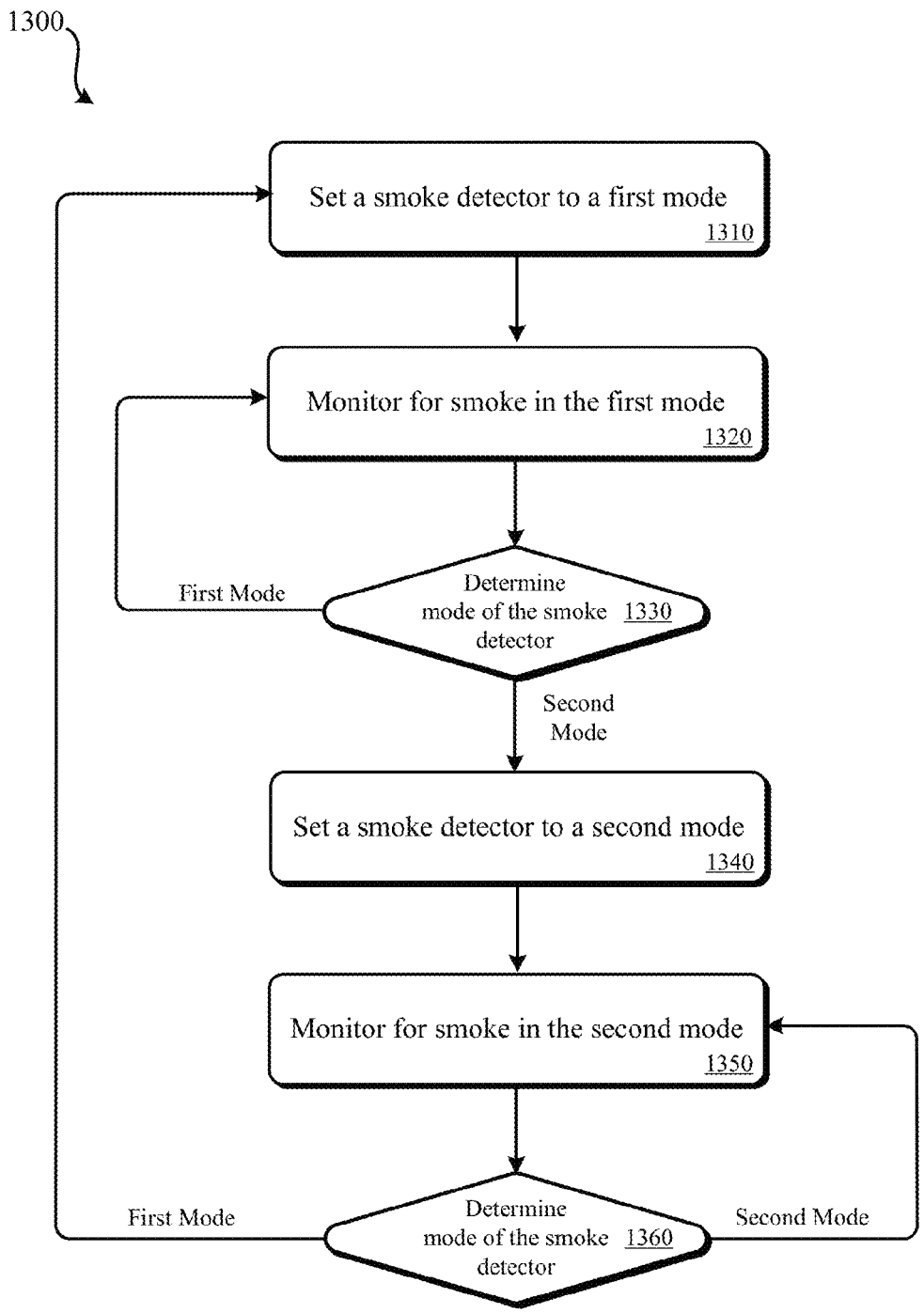
FIG. 13 illustrates an embodiment of a method for using two modes for monitoring for smoke in a smoke chamber.

FIG. 13 illustrates an embodiment of a method 1300 for using two modes for monitoring for smoke in a smoke chamber. "Mode" refers to a state of the device controlled by an on-board processing system of the device. Based on the device's mode, the multiple (i.e., two or more) EM emitters may emit light in different patterns. In some modes, only a single EM emitter is used and the other EM emitter(s) is/are disabled. In some modes, a frequency of enabling of the EM emitters is controlled. Generally speaking, as a level of detected smoke in an environment increases and approaches an alarm limit, the more frequently and accurately the smoke level in the environment should be monitored. While the following description focuses on enabling and disabling EM emitters, it should be understood that an EM sensor's enablement pattern may mirror the EM emitters such that an EM sensor is only powered when an EM emitter is illuminated. In other embodiments, the EM sensor may remain continuously powered and activated. In still other embodiments, the EM sensor may be enabled for longer in duration than the EM emitters, but may still be disabled on a periodic basis to save power and/or prolong the life of the EM sensor.

In reference to FIG. 13, two modes are detailed. The first mode may be activated at the device when the detected smoke level is below a defined, stored threshold level or no smoke is detected. The second mode may be activated at the device when the detected smoke level is above the defined, stored threshold level or some level of smoke is detected. Generally, it may be desirable for the device to be in the first mode as compared to the second mode, because the first mode has one or more EM emitters activated less often. By one or more EM emitters being activated less often, less power is consumed and, possibly, the lifetime of the one or EM emitters is extended. For instance, an EM emitter, which can be in the form of a light emitting diode (LED), can be expected to last for roughly a defined period of time before the EM emitter either stops functioning or its optical output degrades (e.g., in intensity) such that it can no longer reliably be used for the detection of smoke particles.

At block 1310, the smoke detector may be set to a first mode. Setting the smoke detector device to a first mode may take the form of a processing system of the smoke detector storing an indication to memory indicative of the first mode being active. The processing system may control the multiple EM emitters and EM sensor in accordance with a sensing definition of the first mode, as defined below. The smoke detector may be set to the first mode at block 1310 based on: previous measurements of smoke indicating that a threshold level of smoke has not been exceeded, evaluation of a metric that indicates that smoke in the environment is below a threshold, or the smoke detector recently being activated or reset.

At block 1320, the device may monitor for smoke in the first mode. In some embodiments, monitoring for smoke in the first mode occurs as detailed in relation to method 1500 of FIG. 15: only one EM emitter is periodically activated for detecting whether smoke is present in the smoke chamber while at least one other EM emitter is kept disabled (except, possibly, for periodic self-testing). In other embodiments, monitoring for smoke in the first mode occurs as detailed in relation to method 1600 of FIG. 16: at least two EM emitters are alternatingly used for assessing an amount of smoke in the smoke chamber with a period of time being waited between illumination with all EM emitters disabled.

At block 1330, the mode of the smoke detector may be determined. This determination may be based on information gathered while monitoring for smoke at block 1320. Therefore, based on information gathered at block 1320 while monitoring for smoke, the mode of the smoke detector at block 1330 will either be maintained by remaining in first mode and returning to block 1320 or will be modified to a second mode and method 1300 will proceed to block 1340.

To determine the mode for the smoke detector, a metric value may be calculated. For instance, when an embodiment of method 1600 is being used as the first mode, equation 1 may be used to calculate a metric value for use in determining the mode of the smoke detector. When operating in accordance with method 1600, with the two EM emitters alternatingly turned on, two voltage values may be output by the EM sensor based on EM radiation sensed when each EM emitter is individually turned on. This voltage value may be converted into dB/m.

$$\text{Metric}=\text{ired}_{scaling}*\text{ired}_{level}+\text{blue}_{scaling}*\text{blue}_{level} \quad \text{Eq. 1}$$

The unit of measurement on the measured levels of infrared (abbreviated ired) and blue light as detected by the EM sensor can be dB/m. In equation 1, $\text{ired}_{scaling}$ and $\text{blue}_{scaling}$ are scaling factors that are selected by the manufacturer and programming into the device to strike a balance between alarming as early as possible when smoke is present while still complying with established regulations. Since the device can be network-enabled, it should be understood that the scaling factors, along with the use of equation 1, can be adjusted by a service provider after the device has been installed in a user's structure (e.g., home, office, etc.). Therefore, the ability to accurately and quickly detect smoke can be improved over time by providing the device with an updated algorithm and/or scaling factors. In some embodiments, the $\text{ired}_{scaling}$ scaling factor used is 4 and the $\text{blue}_{scaling}$ scaling factor used is 1.

Metric is a function of time (that is, the calculated value of Metric will change as additional measurements are made at block 1320 at different times). The value of Metric can be expected to increase rapidly or slowly, depending on the type of fire and other environmental conditions. The instantaneous value of Metric can be compared against one or more predefined thresholds. The results of these comparisons may be fed into individual rolling windows for evaluation of whether an alarm should be output, a warning should be output, or other action should be taken. When a large enough number of positives has been detected in a given window, a corresponding action is performed. For example, a positive input (e.g., 1) may be entered into a sliding window calculation when the calculated metric is greater than a predefined threshold value, such as 0.15. A negative input (e.g., 0) may be entered into the sliding window calculation when the calculated metric is less than 0.15 or whatever the predefined threshold value is. When a window target value is reached, such as 2 or greater, an event may be performed.

Table 1 lists various windows that may be monitored using the Metric value. The threshold indicates the threshold value against which Metric is compared for generating a positive or negative input to the window. The window target value indicates a summation value that must be reached by the summation of the entries in the window in order to trigger a response or other form of action. Window size indicates the number of Metric inputs that are maintained as part of the rolling window. Window span indicates the amount of time in seconds covered by the window. As an example, as noted in Table 1, UT_warning requires at least two out of five positives to yield a true condition; otherwise UT_warning has a false condition.

TABLE 1

| Window Name | Threshold (dB/m) | Window Target | Window Size | Window Span (seconds) |
|---|---|---|---|---|
| Monitor (fast/slow sampling) | 0.1 | 1 | 5 | 10 |
| UT warning | UT_threshold | 2 | 5 | 10 |
| LT warning | LT_threshold | 5 | 5 | 10 |
| Alarm_CO_present | 0.238 | 6 | 10 | 20 |
| Alarm_CO_absent | 0.330 | 6 | 10 | 20 |
| Alarm_exit | 0.135 | 10 | 10 | 20 |

As noted in Table 1, similar rolling windows may be used for determining whether other conditions are present. For example, Alarm_CO_present may be used to determine when to output an alarm when CO (measured using a CO sensor and compared to a threshold value) has been identified as present in the environment. An alarm may be triggered when Alarm_CO_present is positive. Alarm_CO_absent may be used to determine when to output an alarm when CO (measured using a CO sensor) has been identified as not being present in the environment. An alarm may be triggered when Alarm_CO_absent is positive. If CO is measured as present in the environment, the alarm triggers based on a lower Metric value than if CO is not present.

In Table 1, UT_warning (Upper Threshold warning) and LT_warning (Lower Threshold warning) represent target values associated with the issuance of a warning (as opposed to an alarm) and exiting an existing warning condition, respectively based on the value of Metric. The number of positives within the respective windows needed to satisfy a warning exit criteria may be larger than that needed to trigger a warning condition. In the case of LT_warning, a positive would be generated when a value is measured below LT_threshold; while in the case of UT_warning, a positive would be generated when a value is measured above UT_threshold. Such an arrangement can prevent the device from repeatedly "bouncing" between a warning and non-warning state. Alarm_exit represents a target value associated with exiting an alarm (as opposed to a warning) condition. The number of positives required to exit the alarm condition may be larger than the number needed to trigger an alarm condition, to prevent bouncing. In the case of Alarm_exit, a positive would be generated when a Metric value is measured below the noted threshold for the target number of samples within the window.

Monitor may use the Metric as evaluated in a rolling window to determine a speed of sampling of red and blue light measurements within the smoke chamber. When the threshold is exceeded for the window target number of samples within the window size, fast sampling may be enabled; otherwise it may be disabled. It should be understood that the values used within Table 1 are merely exemplary and may be increased or decreased to alter when the device outputs warnings and/or alarms.

For instance, windows may be monitored to determine when an alarm should be output and when a warning should be output. To be clear, an "alarm" refers to a condition typically associated with a loud noise being created by a smoke detector signaling to persons nearby that smoke is present. The amount of smoke necessary for an alarm to be triggered is typically defined by law or regulation. "Warning" refers to a condition that involves less smoke being detected. A warning level may not be defined by law or regulation, but may be implemented by a smoke detector manufacturer to warn persons nearby that the level of smoke in the environment is rising and that, if the smoke level keeps rising, the alarm condition will occur. A warning may result in a recorded or synthesized auditory message being output by the smoke detector device warning the user of the smoke level; an alarm is typically associated with a loud buzzing sound.

At block 1330, if the value of Metric is above a particular $\text{Metric}_{threshold}$, such as 0.04 or 0.1; the second mode may be entered and method 1300 proceed to block 1340. Otherwise, method 1300 returns to block 1320. To be clear, the modes of operation of methods 1300 and 1400 may be calculated separately from whether a warning or alarm threshold is crossed according to the rolling windows. For instance, in some embodiments, triggering of an output of either a warning or alarm will only occur once Metric has been sufficiently large enough in magnitude to already place the smoke detector in the second mode of method 1300 or third mode of method 1400.

At block 1340, the smoke detector may be set to a second mode. Setting the smoke detector device to a second mode may take the form of a processing system of the smoke detector storing an indication to memory indicative of the second mode now being active. The processing system may control the multiple EM emitters and EM sensor in accordance with a sensing definition of the second mode, as defined below.

At block 1350, the device may monitor for smoke in the second mode. The second mode differs in at least some respect from the first mode. In some embodiments, if monitoring for smoke in the first mode occurs as detailed in relation to method 1500 of FIG. 15, monitoring for smoke in the second mode occurs as detailed in relation to method 1600 of FIG. 16. In other embodiments, if monitoring for smoke in the first mode occurs as detailed in relation to method 1600 of FIG. 16, monitoring for smoke in the second mode may also occur as detailed in relation to method 1600, but the period of time between alternating EM emissions may be changed (e.g., decreased).

At block 1360, the mode of the smoke detector may again be determined. This determination may be performed in the same manner as at block 1330. Based on information gathered while monitoring for smoke at block 1350, a determination may be made as to whether the smoke detector should remain in the second mode (and return to block 1350 for additional monitoring) or the mode of the smoke detector should be set to the first mode at block 1310. Therefore, based on information gathered at block 1350 while monitoring for smoke, the mode of the smoke detector at block 1360 will either be maintained by remaining in second mode and returning to block 1350 or will be modified to the first mode and method 1300 will proceed to block 1310. Just as at block 1330, the Metric value may be calculated and used for determining the mode of the smoke detector, either by direct comparison to a threshold value or by comparing the number of times that the metric value exceeds a threshold value during a sliding window to one or more threshold percentages for a warning or alarm level.

Figure 14:
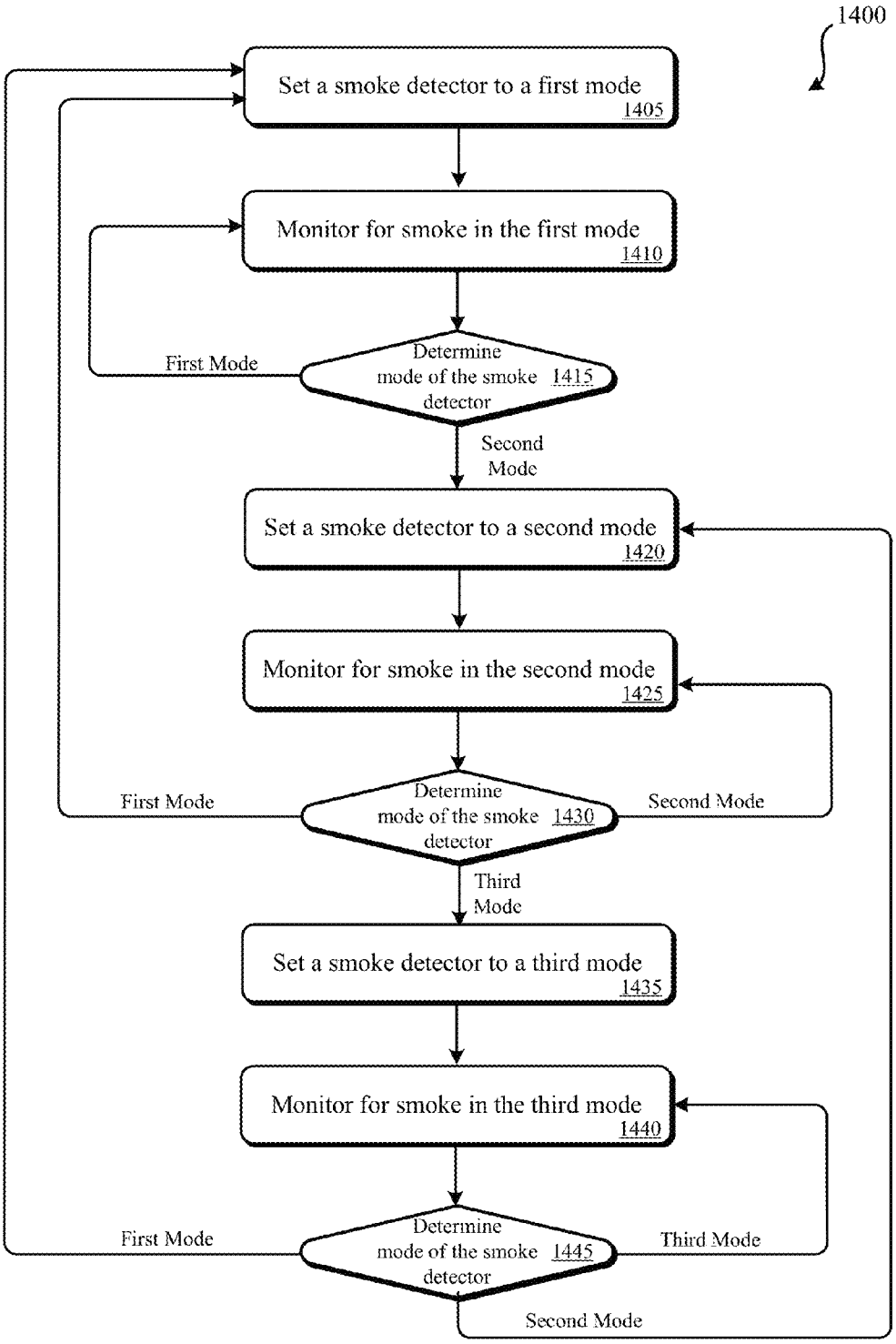
FIG. 14 illustrates an embodiment of a method for using three modes for monitoring for smoke in a smoke chamber.

FIG. 14 illustrates an embodiment of a method 1400 for using three modes for monitoring for smoke in a smoke chamber. Method 1400 may be focused on a smoke detector that uses a first mode when no smoke or very little smoke is detected, a second mode when some smoke is detected, and a third mode when more smoke is detected. Again, it may be desirable for the device to be in the first mode as compared to the second mode or the third mode, because the first mode has one or EM emitters activated less often. By one or more EM emitters being activated less often, less power is consumed and, possibly, the lifetime of the one or EM emitters is extended. For instance, an EM emitter, which can be a form of light emitting diode (LED), can be expected to last for about a defined period of time before the EM emitter either stops functioning or its optical output degrades (e.g., in intensity) such that it can no longer reliably be used for the detection of smoke particles. Similarly, the second mode as detailed in relation to FIG. 14 may be preferable to the third mode for the same reasons.

At block 1405, the smoke detector may be set to a first mode. Setting the smoke detector device to a first mode may take the form of a processing system of the smoke detector storing an indication to memory indicative of the first mode being active. The processing system may control the multiple EM emitters and EM sensor in accordance with a sensing definition of the first mode, as defined below. The smoke detector may be set to the first mode at block 1405 based on: previous measurements of smoke indicating that a threshold level of smoke has not been exceeded, evaluation of Metric that indicates that smoke in the environment is below a low threshold (e.g., 0.04), or the smoke detector recently being activated or reset.

At block 1410, the device may monitor for smoke in the first mode. In some embodiments, monitoring for smoke in the first mode occurs as detailed in relation to method 1500 of FIG. 15—that is only one EM emitter is periodically activated for detecting whether smoke is present in the smoke chamber while at least one other EM emitter is kept disabled (except, possibly, for periodic testing). For instance, the first mode may involve an infrared emitter being activated to permit sampling once every ten seconds. The other emitter(s) may remain disabled, besides for a periodic test. In other embodiments, monitoring for smoke in the first mode occurs as detailed in relation to method 1600 of FIG. 16—that is, at least two EM emitters are alternatingly used for assessing an amount of smoke in the smoke chamber with a period of time being waited between illumination with all EM emitters disabled. For instance, both infrared and blue emitters and an EM sensor may be activated to allow for sampling of each to occur once every ten seconds or some other time period. The amount of time between the red and blue emitters being enabled may be a time such as 12.45 msecs. Other times may also be possible, such as between 5 msecs and 1 second, depending on the characteristics of the emitters and sensor.

At block 1415, the mode of the smoke detector may be determined. This determination may be performed in the same manner as detailed at block 1330 of FIG. 13. At block 1415, the $\text{Metric}_{Threshold}$ value used may be 0.04. Therefore, if Metric is greater than 0.04, the second mode may be entered. Based on information gathered while monitoring for smoke at block 1410, a determination may be made as to whether the smoke detector should remain in the first mode (and return to block 1410 for additional monitoring) or the mode of the smoke detector should be set to the second mode (or directly jumping to the third mode) at block 1415. Therefore, based on information gathered at block 1410 while monitoring for smoke, the mode of the smoke detector at block 1415 will either be maintained by remaining in the first mode and returning to block 1410 or will be modified to the second (or, possibly, third) mode and method 1400 will proceed to block 1420. As previously detailed, at block 1415, the metric value may be calculated and used for determining the mode of the smoke detector, either by direct comparison to a threshold value or by comparing the number of times that the metric value exceeds a threshold value during a sliding window to one or more threshold percentages for a warning or alarm level. In some embodiments, the defined threshold metric value may be 0.15 to determine if the second mode should be entered.

At block 1420, the smoke detector may be set to a second mode. Setting the smoke detector device to a second mode may take the form of a processing system of the smoke detector storing an indication to memory indicative of the second mode being active. The processing system may control the multiple EM emitters and EM sensor in accordance with a sensing definition of the second mode, as defined below.

At block 1425, the device may monitor for smoke in the second mode. In some embodiments, monitoring for smoke in the second mode occurs as detailed in relation to method 1600 of FIG. 16—that is, at least two EM emitters are alternatingly used for assessing an amount of smoke in the smoke chamber with a period of time being waited between illumination with all EM emitters disabled. The second mode may be assigned a defined wait period of time, which may indicate an amount of time that is waited between the EM emitters being intermittently activated.

At block 1430, the mode of the smoke detector may be determined. This determination may be performed in the same manner as previously detailed at block 1330 of FIG. 13. Based on information gathered while monitoring for smoke at block 1425, a determination may be made as to whether the smoke detector should remain in the second mode (and return to block 1425 for additional monitoring) or the mode of the smoke detector should be set to the third mode or the first mode. Therefore, based on information gathered at block 1425 while monitoring for smoke, the mode of the smoke detector at block 1430 will either be maintained by remaining in the second mode and returning to block 1410 for the first mode, or will be set to the third mode and method 1400 will proceed to block 1435. As previously detailed, at block 1430, the metric value may be calculated and used for determining the mode of the smoke detector, either by direct comparison to a threshold value or by comparing the number of times that the metric value exceeds a threshold value during a sliding window to one or more threshold percentages for a warning or alarm level. In some embodiments, if Metric is less than a threshold of 0.04, the first mode may be entered, if Metric is between thresholds of 0.04 and 0.1, the second mode may remain being used, and if Metric is greater than a threshold of 0.1, the third mode may be entered. It should be understood that the various values for such thresholds are merely exemplary.

At block 1435, the smoke detector may be set to a third mode. Setting the smoke detector device to the third mode may include the processing system of the smoke detector storing an indication to memory indicative of the second mode being active. The processing system may control the multiple EM emitters and EM sensor in accordance with a sensing definition of the second mode, as defined below. For instance, in the third mode both infrared and blue emitters may be activated to allow for sampling of each once every two seconds or some other time period. The amount of time between the red and blue emitters being enabled may be a time such as 12.45 msecs. Other times are also possible, such as between 5 msecs and 1 second, depending on the characteristics of the emitters and sensor. The time period of the third mode can be expected to be less than the time period of the second mode.

At block 1440, the device may monitor for smoke in accordance with the third mode. In some embodiments, monitoring for smoke in the third mode occurs as detailed in relation to method 1600 of FIG. 16—that is, at least two EM emitters are alternatingly used for assessing an amount of smoke in the smoke chamber with a period of time being waited between illumination with all EM emitters disabled. The third mode may include a defined wait period of time, which may indicate an amount of time that is waited between the EM emitters being intermittently activated. The defined wait period of time for the third mode may be shorter in duration than the defined period of time for this second mode.

At block 1445, the mode of the smoke detector may again be determined. This determination may be performed in the same manner as previously detailed at block 1330 of FIG. 13. Based on information gathered while monitoring for smoke at block 1440, a determination may be made as to whether the smoke detector should remain in the third mode (and return to block 1440 for additional monitoring) or the mode of the smoke detector should be set to the second mode or the first mode. Therefore, based on information gathered at block 1440 while monitoring for smoke, the mode of the smoke detector at block 1445 will either be maintained by remaining in the third mode, return to block 1410 for the first mode, or be set to the second mode at block 1420. As previously detailed, at block 1430, the Metric value may be calculated and used for determining the mode of the smoke detector, either by direct comparison to one or more threshold values or by comparing the number of times that the metric value exceeds one or more threshold values during a sliding window as compared to one or more threshold percentage values for warning or alarm levels. In some embodiments, if Metric is less than a threshold of 0.04, the first mode may be entered, if Metric is between thresholds of 0.04 and 0.1, the second mode may be used, and if Metric is greater than a threshold of 0.1, the third mode may be used.

The smoke detector device that performs method 1400 may be configured to output a warning (an indication that a smoke level is rising but has not yet triggered an alarm) and an alarm. The third mode (which results in the fastest rate of sampling) may be triggered at a lower smoke level than the warning level. Therefore, by the time the smoke detector device outputs an auditory warning of an increasing smoke level, the smoke detector device may have already moved from the first mode, to the second mode, and then to the third mode due to the detected level of smoke. Rolling windows, as previously detailed, may be used to determine whether a warning or an alarm should be output based on the Metric value.

It should be noted that, throughout this document, reference is made to "first" and "second" modes. Reference is also made to "first" and "second" emitters. These designators are not meant to confer any necessary order or sequence to use of the modes and/or emitters. Rather, these numerical designators are merely intended for clarity as to which mode or emitter the document is currently referring.

Figure 15:
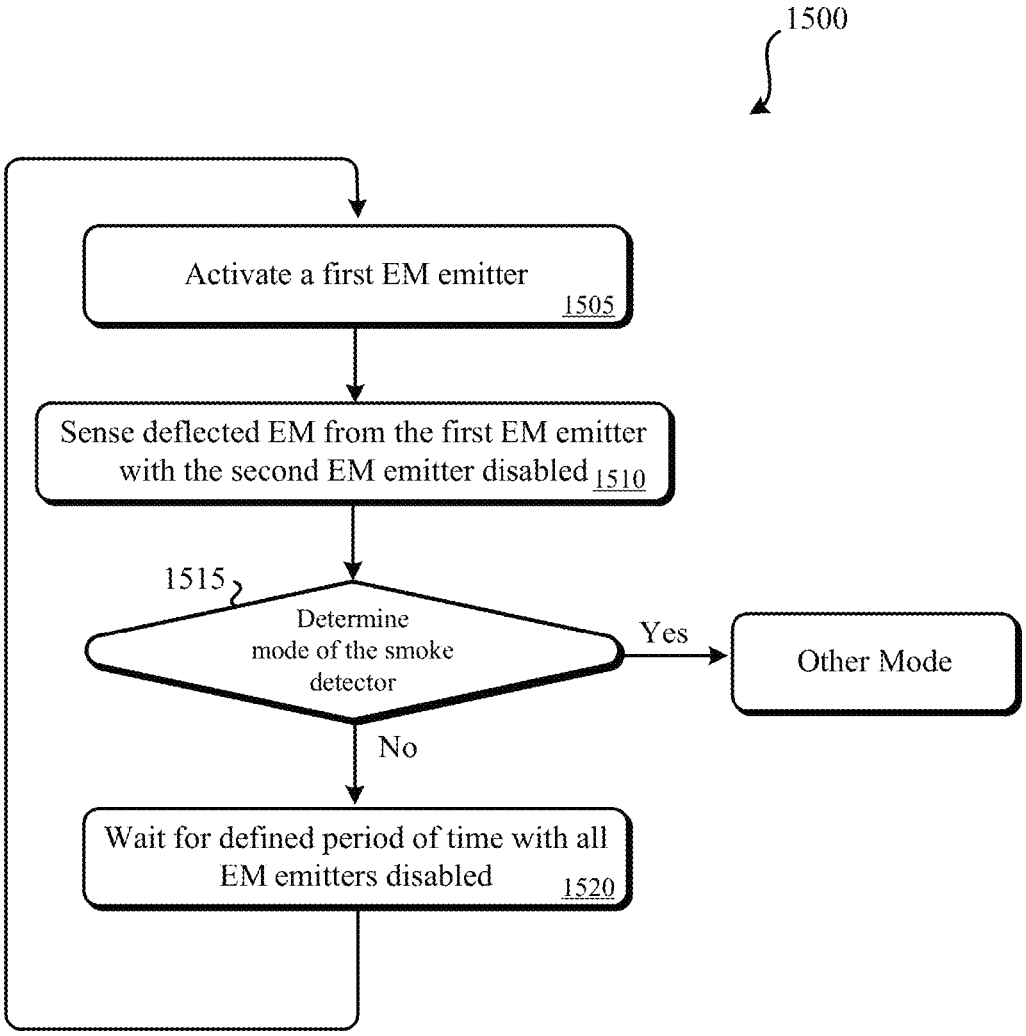
FIG. 15 illustrates an embodiment of a method for performing a mode for detecting smoke within a smoke chamber.

FIG. 15 illustrates an embodiment of a method 1500 for performing a mode for detecting smoke in a smoke chamber. For example, method 1500 may be used as the first mode in methods 1300 and/or 1400. As mentioned in relation to FIGS. 13 and 14, while the following description focuses on enabling and disabling EM emitters, it should be understood that an EM sensor's enablement pattern may mirror the EM emitters such that an EM sensor is only powered when an EM emitter is illuminated. In other embodiments, the EM sensor may remain continuously powered and activated. In still other embodiments, the EM sensor may be enabled for longer in duration than the EM emitters, but may still be disabled on a periodic basis to save power and/or prolong the life of the EM sensor. Typically, method 1500 corresponds to a situation where no or very little smoke has been detected by the smoke detector. Of the various modes detailed in this document, method 1500 can result in the least amount of power being consumed and/or EM emitters being, in total, illuminated for the least amount of time (thereby prolonging their collective functional lives).

At block 1505, a first EM emitter is activated. In some embodiments, the first EM emitter is an infrared EM emitter. An infrared EM emitter may be used as the first EM emitter because infrared EM emitters may tend to have a longer lifespan than at least some other types of EM emitters, such as blue light EM emitters. The first EM emitter may be activated for a defined period of time. During this period of time, each other EM emitter present in the smoke chamber is disabled such that the first EM emitter is the only EM emitter outputting EM radiation. During this period of time when the first EM emitter is active at block 1505, an EM sensor may make a measurement as to an amount of EM radiation sensed at block 1510. Since the measurement occurs within a smoke chamber designed to eliminate or nearly eliminate the presence of light from the external environment, any light sensed by the EM sensor would most likely be generated by the first EM emitter and, if a significant amount of EM radiation is detected, would have been scattered by particulate matter present within the smoke chamber.

At block 1515, it may be evaluated whether the mode of the smoke detector has changed. This evaluation may represent one of the previous decision blocks, such as block 1330, where the mode of the smoke detector is reevaluated while the first mode is currently active. If the mode is determined to have changed, based on the measurements sensed at block 1510, the first mode may be changed to some other mode (such as a second or third mode detailed in relation to FIG. 16). If the determination at block 1515 results in the first mode being maintained, method 1500 may proceed to block 1520. At block 1520, a period of time may be waited during which all EM emitters are disabled. This period of time may be 1985 milliseconds (msecs) in duration when a two second sampling rate is in effect. Of course, in other embodiments, this period of time may be longer of shorter, such as any value between 1000 msecs and 3000 msecs.

Following block 1520, method 1500 may return to block 1505. To be clear, the second EM emitter of the device may not be activated for smoke detection in method 1500. Therefore, if method 1500 is used for an extended period of time (which may be typical if smoke is very infrequently determined to be present at block 1515), the second (and/or third) EM emitter may not be used for smoke detection very often. While the second EM emitter may not be used for smoke detection in method 1500, periodically, the device performing method 1500 may perform a test of a second EM emitter. For example, during block 1520, the second EM emitter may be occasionally activated. For instance, in some embodiments, the second EM emitter, which may emit blue light, may be activated once every 200 seconds. In other embodiments, the test period may be other than 200 seconds; for instance, the test period may be any time between 5 and 5000 seconds. If the second EM emitter is functioning properly, the EM sensor may be able to detect a small amount of EM radiation within the smoke chamber, even if no particulate matter is present to deflect the EM radiation emitted by the second EM emitter. That is, the smoke chamber itself may cause a small amount of EM radiation from the active second EM emitter to be deflected/reflected into the EM sensor. If, during this test, at least a test threshold amount of EM radiation is determined to have been sensed by the EM sensor, the second EM emitter is assumed to be functioning properly. While method 1500 does not use the second EM emitter for sensing smoke, method 1500 permits such a periodic test of the second EM emitter to ensure proper functionality.

A similar test may be performed for the first EM emitter as part of block 1510. Since the first EM emitter is periodically active during method 1500, the smoke chamber itself may cause a small amount of EM radiation from the active first EM emitter to be deflected/reflected into the EM sensor. If, during block 1510, at least a test threshold amount of EM radiation is determined to have been sensed by the EM sensor, the first EM emitter is assumed to be functioning properly. Different test thresholds may be used for each EM emitter, depending on the wavelength of output EM radiation. Therefore, a different test threshold may be used for blue light as compared to infrared EM radiation.

Figure 16:
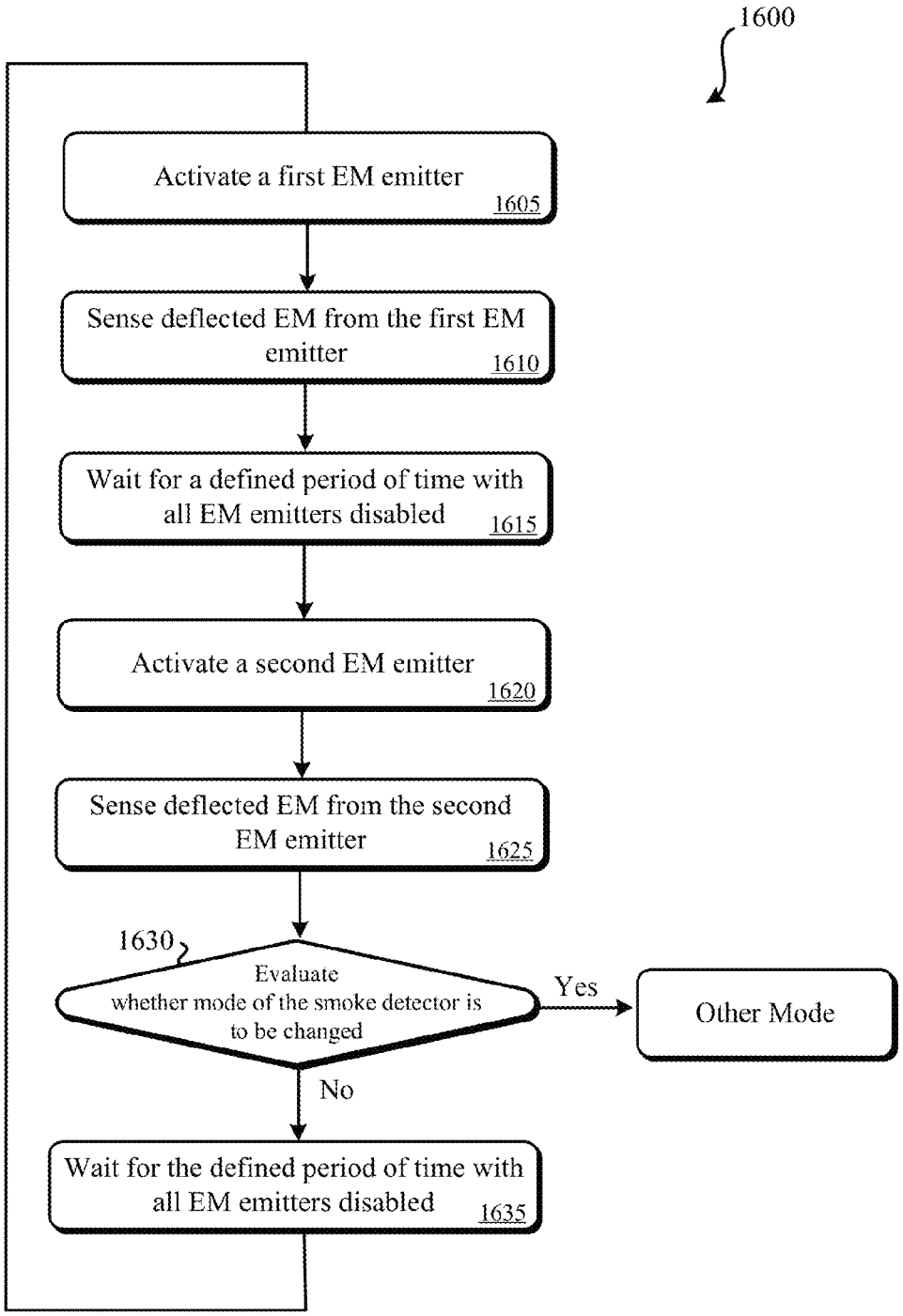
FIG. 16 illustrates an embodiment of a method for performing another mode for detecting smoke within a smoke chamber.

FIG. 16 illustrates an embodiment of a method 1600 for performing a mode for detecting smoke within a smoke chamber. For example, method 1500 may be used as the first and second mode in method 1300, just the second mode in method 1300, all of the modes in method 1400, or the second two modes of method 1400. As mentioned in relation to FIGS. 13-15, while the following description focuses on enabling and disabling EM emitters, it should be understood that an EM sensor's enablement pattern may mirror the EM emitters such that an EM sensor is only powered when an EM emitter is illuminated. In other embodiments, the EM sensor may remain continuously powered and activated. In still other embodiments, the EM sensor may be enabled for longer in duration than the EM emitters, but may still be disabled on a periodic basis to save power and/or prolong the life of the EM sensor.

Method 1600 can be used in the form of multiple modes by varying the period of time at block 1635. For instance, if method 1600 is used as both modes in method 1300, for the first mode, method 1600 may have a wait time at blocks 1615 and/or 1635 that is double or triple the wait time used in the second mode version of method 1600. As such, a large number of modes can be created using method 1600 simply by varying the wait time of blocks 1615 and/or 1635.

At block 1605, a first EM emitter is activated. In some embodiments, the first EM emitter is an infrared EM emitter; in others, it is a blue light emitter. The first EM emitter may be activated for a defined period of time. During this period of time, each other EM emitter present in the smoke chamber is disabled such that the first EM emitter is the only EM emitter outputting EM radiation. During this period of time when the first EM emitter is active at block 1605, an EM sensor may make a measurement as to an amount of EM radiation sensed at block 1610. Since the measurement occurs within a smoke chamber designed to eliminate or nearly eliminate the presence of light from the external environment, any light sensed by the EM sensor would most likely be generated by the first EM emitter and, if a significant amount of EM radiation is detected, would have been scattered by particulate matter present within the smoke chamber.

At block 1615, a period of time may be waited during which all EM emitters are disabled. This period of time may be 12.45 msecs in duration. The time period allocated for block 1615 may be required to be long enough to allow a smooth on-to-off transition for the active emitter (e.g., accounting for worst case transients). Other embodiments in which the period of time is longer or shorter in duration may also be possible, such as between 6-20 msecs. depending on the characteristics of the emitter.

At block 1620, the second EM emitter is activated. The second EM emitter may be activated for the same defined period of time as used at block 1605 or a defined period of time specifically assigned to the second EM emitter. During the active period of time for the second EM emitter, each other EM emitter present in the smoke chamber is disabled such that the second EM emitter is the only EM emitter outputting EM radiation. During this period of time when the second EM emitter is active at block 1620, the EM sensor (which is the same EM sensor as at block 1610) may make a measurement as to an amount of EM radiation sensed at block 1625. Since the measurement occurs within a smoke chamber designed to eliminate or nearly eliminate the presence of light from the external environment, any light sensed by the EM sensor would most likely be generated by the second EM emitter and, if a significant amount of EM radiation is detected, would have been scattered by particulate matter present within the smoke chamber.

At block 1630, it may be evaluated whether the mode of the smoke detector has changed. This evaluation may represent one of the previous decision blocks, such as block 1330, where the mode of the smoke detector is reevaluated. If the mode is determined to have changed, based on the measurements sensed at blocks 1610 and 1625, the mode may be changed to some other mode. If the determination at block 1630 results in the first mode being maintained, method 1600 may proceed to block 1635.

At block 1635, a period of time may be waited during which all EM emitters are disabled. This period of time may be 1985 msecs in duration for a two second sampling rate. More time spent in this block means less frequent emitter activity, leading to savings in power and to increased longevity in the functional lifespan of the EM emitters. Of course, in other embodiments, this period of time may be longer of shorter, such as any value between 1000 msecs and 3000 msecs.

Following block 1635, method 1600 may return to block 1605. Since method 1600 involves both EM emitters being activated, a dedicated test step for either of the EM emitters is not necessary. Rather, as previously detailed, during one of the sensing blocks (i.e., blocks 1610 and 1625), it may be determined whether at least a minimum threshold amount of EM radiation is sensed (even when no particulate matter is present in the smoke chamber) due to internal reflection characteristics of the smoke chamber. If at least a minimum threshold amount of EM radiation is sensed, it may be assumed that the associated EM emitter is functioning properly. This minimum threshold amount is based on the wavelength of EM radiation emitted by the EM emitter and/or other characteristics of the EM emitter (e.g., field of projection of EM radiation).

As detailed in relation to method 1600, multiple different modes can be created by varying the defined period of time used for waiting at blocks 1615 and 1635. Similarly, method 1500 of FIG. 15 can be used to create multiple modes by varying the defined period of time used for waiting at block 1520. For example, referring to FIG. 14, the first mode may correspond to method 1600 using a first, longer defined period of time for block 1520 and the second mode may correspond to method 1600 using a second, shorter defined period of time for block 1520.

Figure 17:
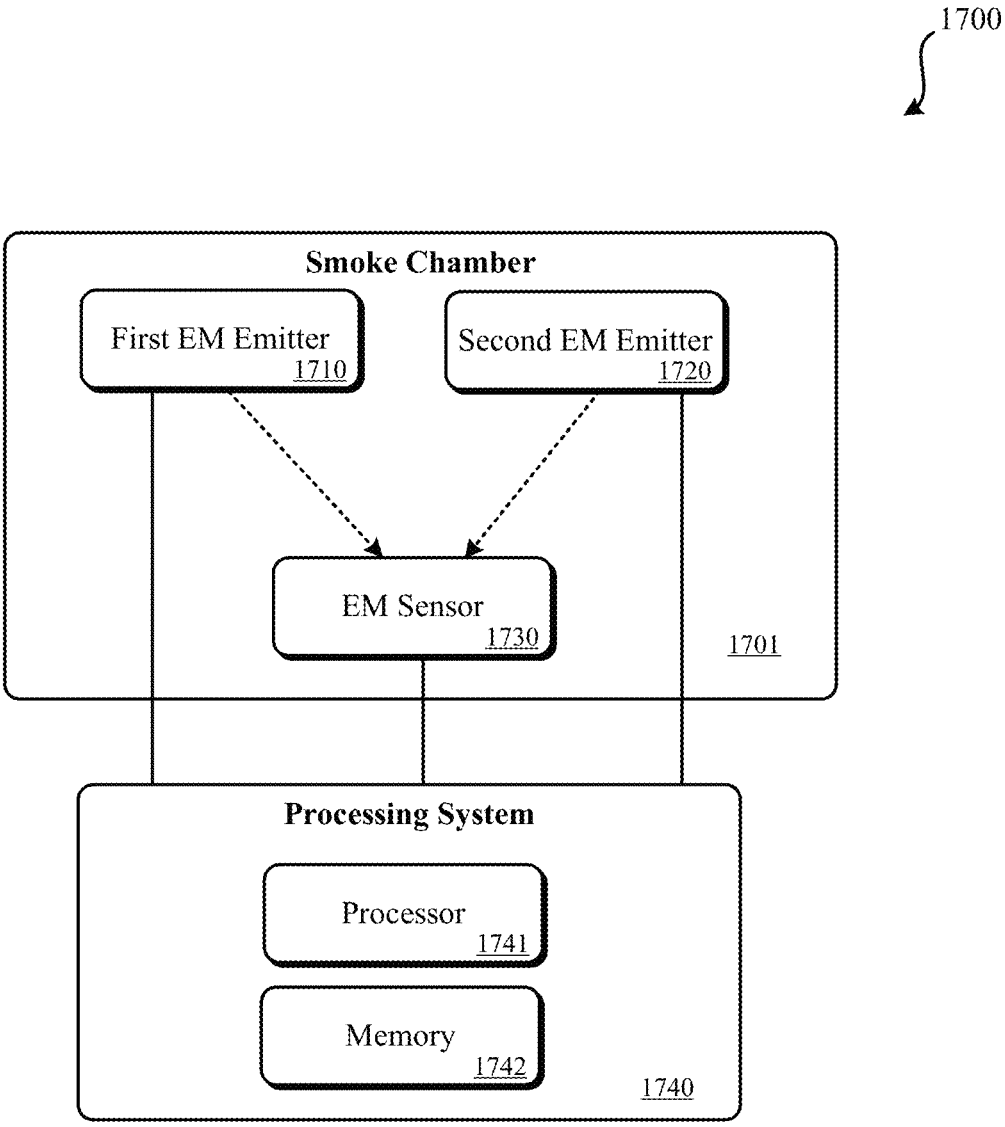
FIG. 17 illustrates an embodiment of a system that may perform various methods of detecting smoke.

FIG. 17 illustrates an embodiment of a system 1700 that may perform various methods of detecting smoke. System 1700 represents a simplified diagram of a system that may be present in a smoke detector device, such as the smoke detectors of FIGS. 1-2C. It should be understood that various other embodiments of system 1700 may include more than two EM emitters and/or may use more than one EM sensor.

System 1700 may include: smoke chamber 1701, first EM emitter 1710, second EM emitter 1720, and EM sensor 1730. Smoke chamber 1701 can represent any of the various embodiments of a smoke chamber discussed in relation to FIGS. 2C-FIG. 12. Other embodiments of smoke chambers may also be used as part of system 1700. First EM emitter 1710, second EM emitter 1720, and EM sensor 1730 are shown within smoke chamber 1701—as detailed in relation to FIGS. 2C—FIG. 11, such components may partially enter smoke chamber 1701 or at least have a field of view that extends into smoke chamber 1701. First EM emitter 1710, second EM emitter 1720, and EM sensor 1730 may communicate with processing system 1740.

Processing system 1740 may control when first EM emitter 1710, second EM emitter 1720, and EM sensor 1730 are turned on (enabled) and turned off (disabled). Processing system 1740 may enable and disable EM emitters 1710 and 1720 in accordance with methods 1300-1600. Processing system 1740 may receive voltage measurements from EM sensor 1730 at least when such EM emitters 1710 and 1720 are enabled.

Processing system 1740 may include one or more processors, such as processor 1741, and non-transitory computer-readable memory 1742. Therefore processing means can involve the use of one or more processors that serve to control first EM emitter 1710, second EM emitter 1720, and EM sensor 1730 and can perform methods 1300-1600. Memory 1742 may be used to store instructions that cause processor 1741 (and/or any other processor) to perform blocks of the methods 1300-1600. In some embodiments, processor 1741 may be specialized to perform such methods directly. In some embodiments, firmware can be instantiated on processor 1741 to perform such methods.

Figure 18:
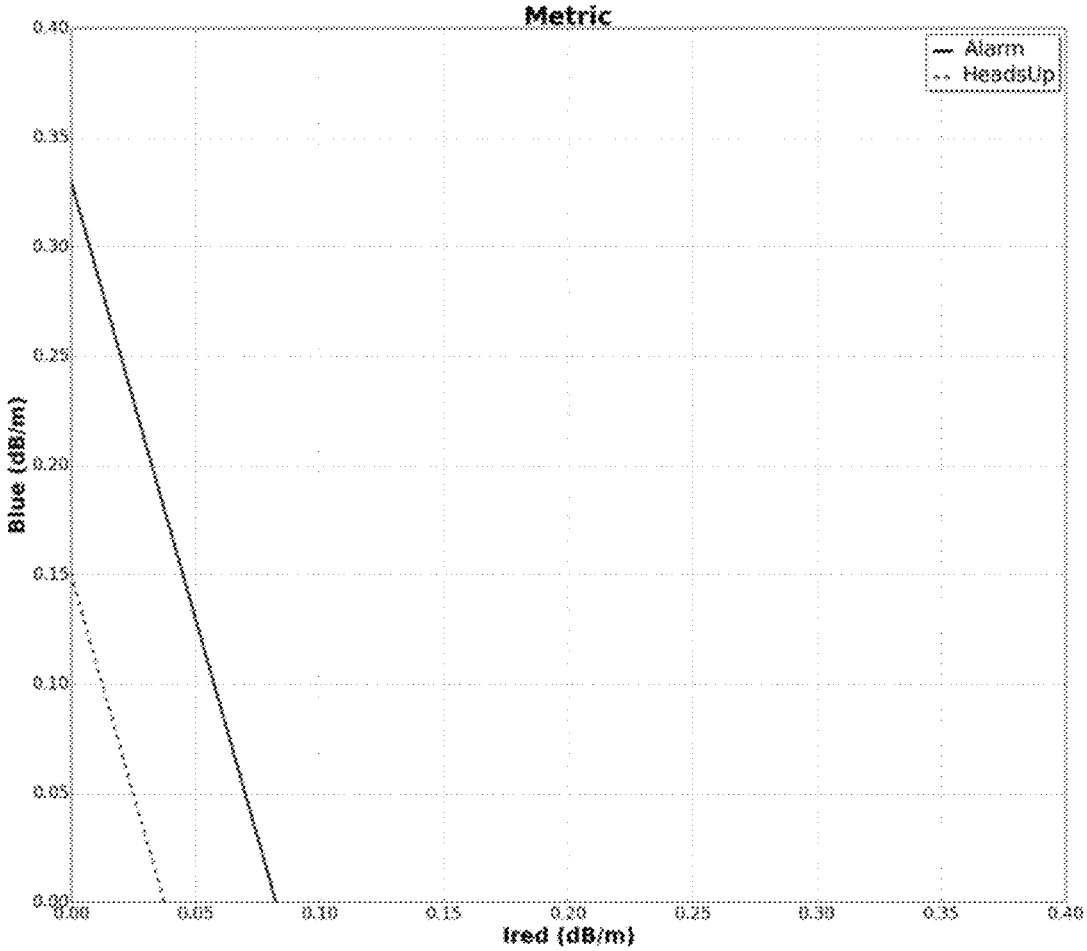
FIG. 18 illustrates an embodiment of a graph showing the relationship between infrared and blue light measurements by an EM sensor.

FIG. 18 illustrates an embodiment of a graph showing the relationship between infrared and blue light measurements by an EM sensor. The instantaneous Metric is compared against these thresholds to assess whether smoke has reached warning or alarm levels. The graph of FIG. 18 shows a threshold line for an alarm and a threshold line for a "Heads Up" message, which serves as a warning as to rising smoke levels. In FIG. 18, $ired_{level}$ on the x-axis is graphed against $blue_{level}$. The dotted line indicates where the combination of the measured $ired_{level}$ and the measured $blue_{level}$ will trigger a warning. The solid line indicates where the combination of the measured $ired_{level}$ and the measured $blue_{level}$ will trigger an alarm. Therefore, when a combination of the measured blue light by the EM sensor and the measured infrared EM radiation by the EM sensor results in a point on the graph to the right of "heads up" but to the left of "alarm", a positive (true) is input into the warning sliding window. When a sufficient number of positives has been detected within the allotted time span of the warning sliding window, an auditory warning (e.g., recorded or synthesized message, flashing or pulsing light of a particular color, such as yellow) may be output. When a combination of the measured blue light by the EM sensor and the measured infrared EM radiation by the EM sensor results in a point on the graph to the right of "alarm", a positive (true) is input into the alarm sliding window. When a sufficient number of positives has been detected within the allotted time span of the alarm sliding window, an alarm (e.g., loud buzzer) may be sounded. The calculated value of Metric from equation one can be used to determine if the threshold defined by the dotted line (warning threshold) is exceeded and/or the threshold defined by the solid line (alarm threshold) is exceeded by defining a threshold value for comparison with Metric and defining the scaling factors of equation 1. Therefore, the threshold lines of FIG. 18 can be defined by setting a threshold value for Metric and selecting particular scaling factors for $ired_{scaling}$ and $blue_{scaling}$.

Figure 19:
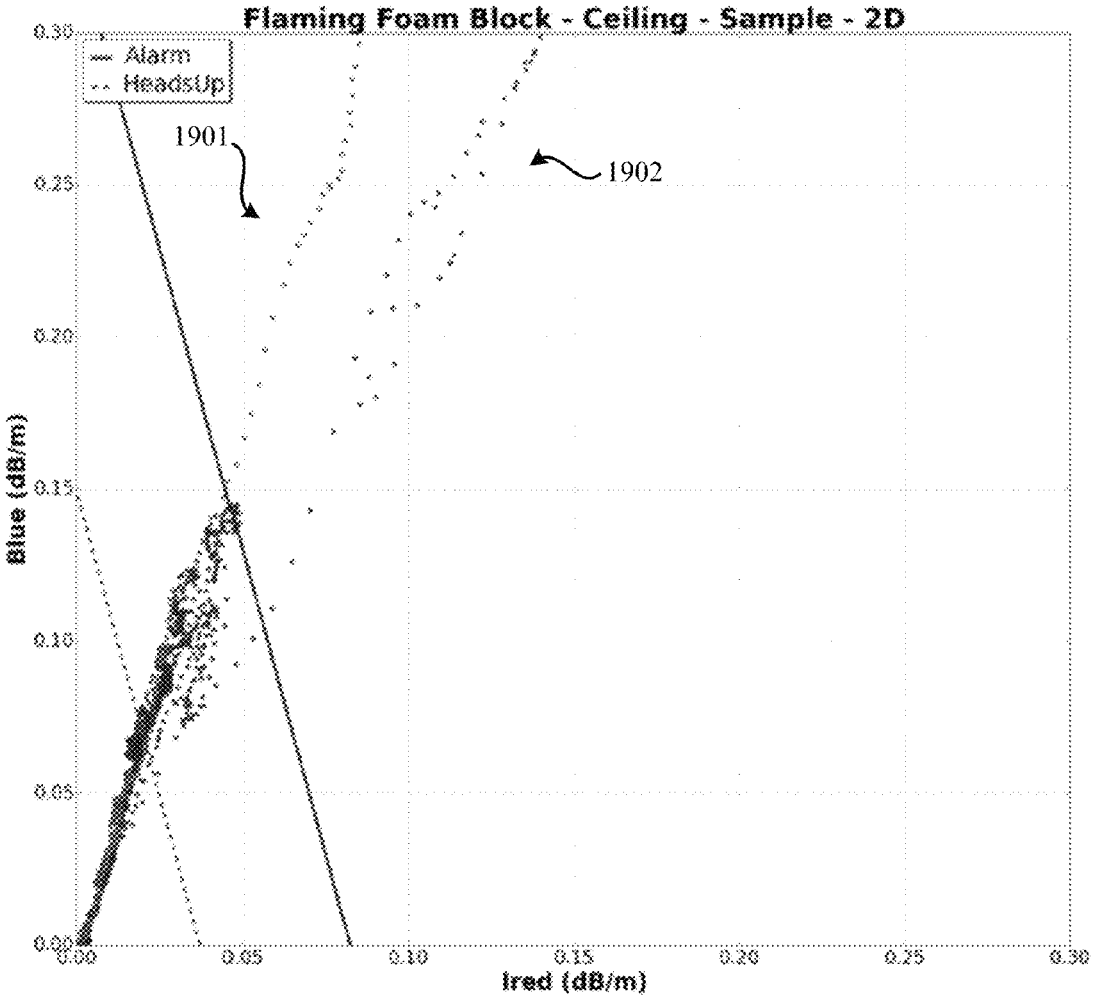
FIG. 19 illustrates an embodiment of the graph of FIG. 18 showing data points from two foam block fires.

FIG. 19 illustrates an embodiment of the graph of FIG. 18 showing data points from two separate foam block fires. The various data points presented were gathered over time. As can be seen, the two fires have roughly the same properties early during the fire, but a first fire (associated with data points 1901) caused a relative greater amount of deflected blue light to be detected, while a second fire (associated with data points 1902) caused a relative greater amount of deflected infrared light to be detected. When the value of $ired_{level}$ and $blue_{level}$ exceed the "headsup" threshold, a warning may be sounded and when the value of $ired_{level}$ and $blue_{level}$ exceed the "alarm" threshold, an alarm may be sounded by the device.

Figure 20:
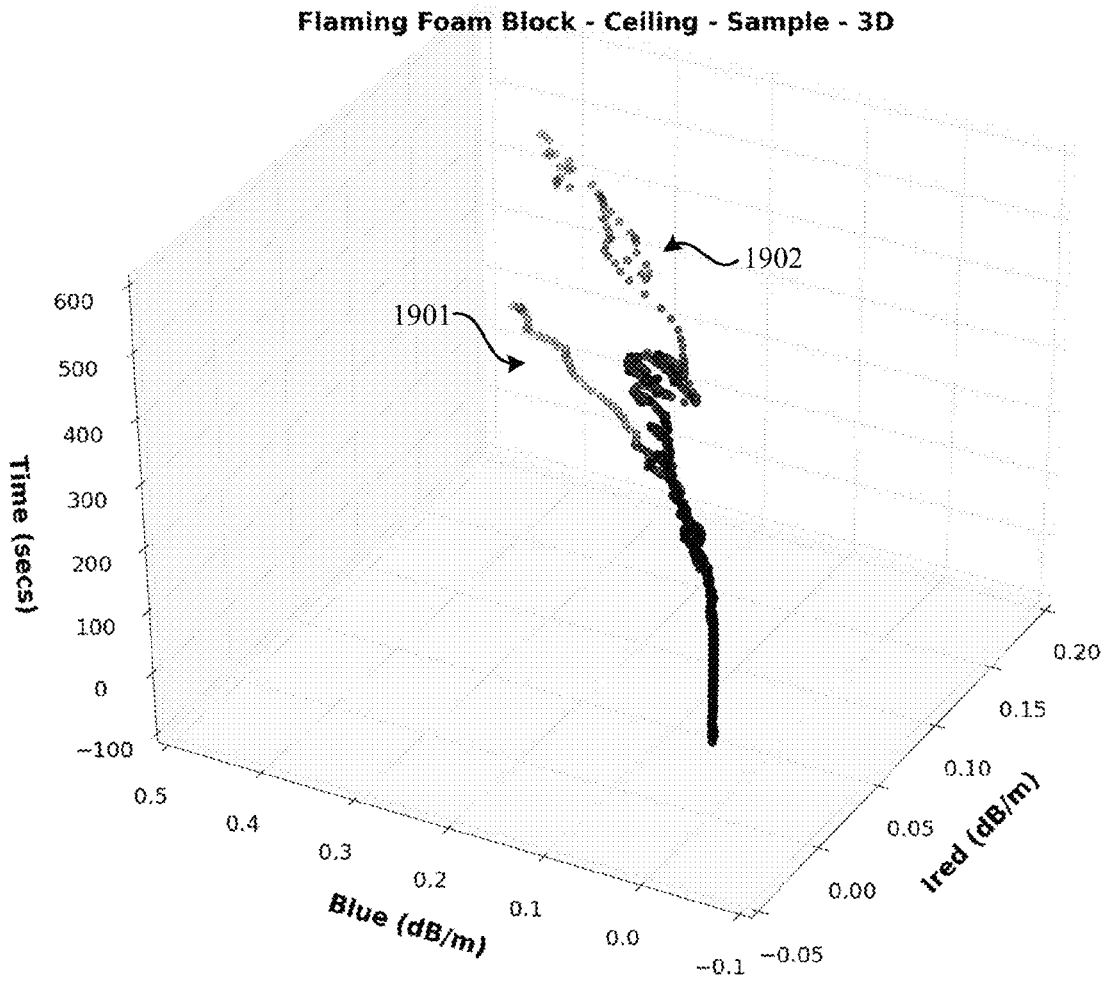
FIG. 20 illustrates an embodiment of the graph of FIG. 19 showing data points from the two foam block fires in three dimensions against time.

FIG. 20 illustrates an embodiment of the graph of FIG. 19 showing data points from the two foam block fires in three dimensions against time. It can be seen how as time increases, the characteristics of the fires varied. Such variance may be due at least in part to differences in environment (e.g., temperature, humidity) and air flow conditions due to the units locations with respect to the fire source and to the inherent randomness in the smoke behavior.

Figure 21:
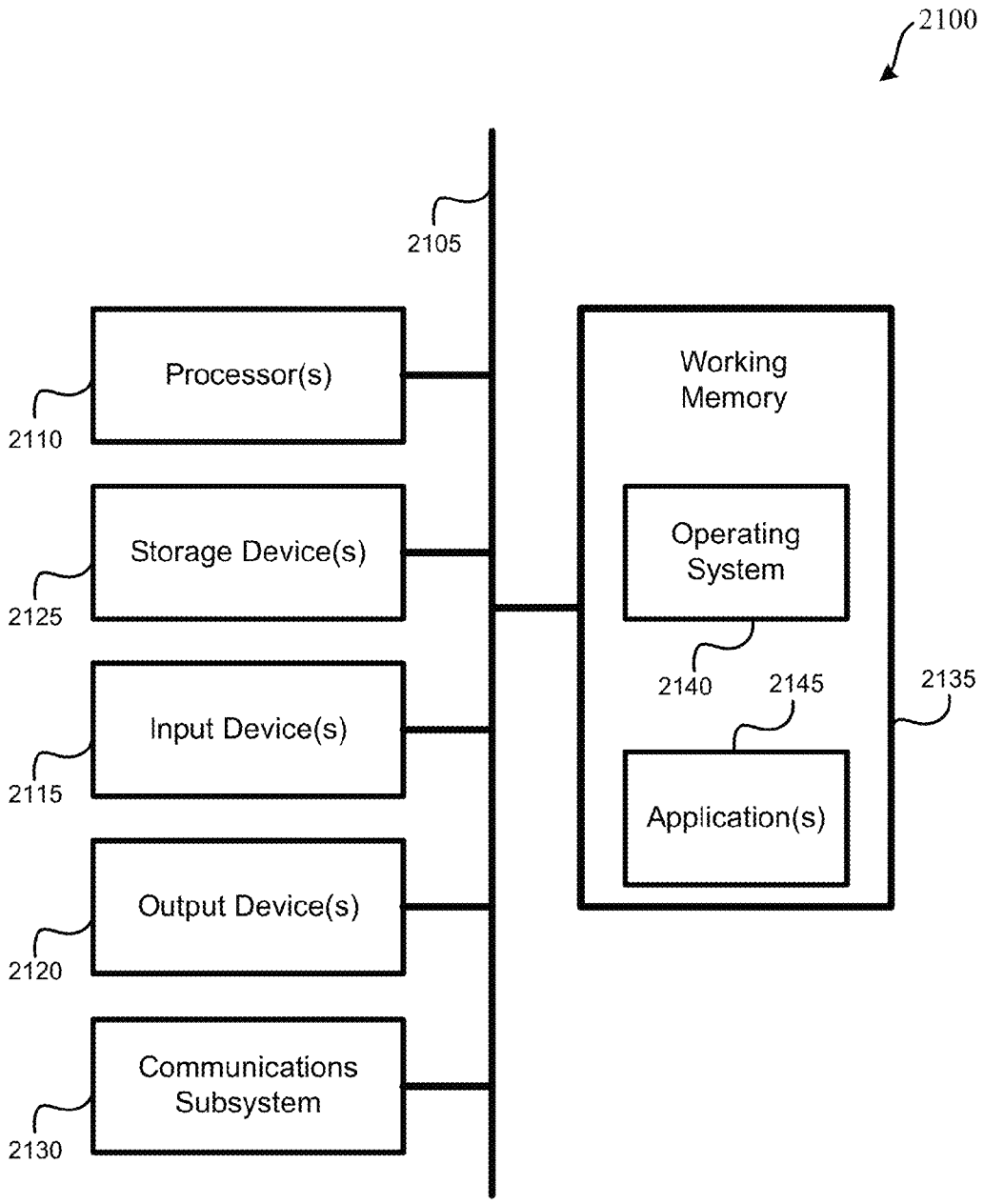
FIG. 21 illustrates an embodiment of a computer system which may be incorporated as part of the smoke detector and/or carbon monoxide devices detailed herein.

A computer system as illustrated in FIG. 21 may be incorporated as part of the previously described computerized devices, such as the processing system of FIG. 17 or on-board the device of FIG. 2C. FIG. 21 provides a schematic illustration of one embodiment of a computer system 2100 that can perform various steps of the methods provided by various embodiments. It should be noted that FIG. 21 is meant only to provide a generalized illustration of various components, any or all of which may be utilized as appropriate. FIG. 21, therefore, broadly illustrates how individual system elements may be implemented in a relatively separated or relatively more integrated manner.

The computer system 2100 is shown comprising hardware elements that can be electrically coupled via a bus 2105 (or may otherwise be in communication, as appropriate). The hardware elements may include one or more processors 2110, including without limitation one or more general-purpose processors and/or one or more special-purpose processors (such as digital signal processing chips, graphics acceleration processors, video decoders, and/or the like); one or more input devices 2115, which can include without limitation a mouse, a keyboard, remote control, and/or the like; and one or more output devices 2120, which can include without limitation a display device, a printer, and/or the like.

The computer system 2100 may further include (and/or be in communication with) one or more non-transitory storage devices 2125, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable and/or the like. Such storage devices may be configured to implement any appropriate data stores, including without limitation, various file systems, database structures, and/or the like.

The computer system 2100 might also include a communications subsystem 2130, which can include without limitation a modem, a network card (wireless or wired), an infrared communication device, a wireless communication device, and/or a chipset (such as a Bluetooth™ device, an 802.11 device, a WiFi device, a WiMax device, cellular communication device, etc.), and/or the like. The communications subsystem 2130 may permit data to be exchanged with a network (such as the network described below, to name one example), other computer systems, and/or any other devices described herein. In many embodiments, the computer system 2100 will further comprise a working memory 2135, which can include a RAM or ROM device, as described above.

The computer system 2100 also can comprise software elements, shown as being currently located within the working memory 2135, including an operating system 2140, device drivers, executable libraries, and/or other code, such as one or more application programs 2145, which may comprise computer programs provided by various embodiments, and/or may be designed to implement methods, and/or configure systems, provided by other embodiments, as described herein. Merely by way of example, one or more procedures described with respect to the method(s) discussed above might be implemented as code and/or instructions executable by a computer (and/or a processor within a computer); in an aspect, then, such code and/or instructions can be used to configure and/or adapt a general purpose computer (or other device) to perform one or more operations in accordance with the described methods.

A set of these instructions and/or code might be stored on a non-transitory computer-readable storage medium, such as the non-transitory storage device(s) 2125 described above. In some cases, the storage medium might be incorporated within a computer system, such as computer system 2100. In other embodiments, the storage medium might be separate from a computer system (e.g., a removable medium, such as a compact disc), and/or provided in an installation package, such that the storage medium can be used to program, configure, and/or adapt a general purpose computer with the instructions/code stored thereon. These instructions might take the form of executable code, which is executable by the computer system 2100 and/or might take the form of source and/or installable code, which, upon compilation and/or installation on the computer system 2100 (e.g., using any of a variety of generally available compilers, installation programs, compression/decompression utilities, etc.), then takes the form of executable code.

It will be apparent to those skilled in the art that substantial variations may be made in accordance with specific requirements. For example, customized hardware might also be used, and/or particular elements might be implemented in hardware, software (including portable software, such as applets, etc.), or both. Further, connection to other computing devices such as network input/output devices may be employed.

As mentioned above, in one aspect, some embodiments may employ a computer system (such as the computer system 2100) to perform methods in accordance with various embodiments of the invention. According to a set of embodiments, some or all of the procedures of such methods are performed by the computer system 2100 in response to processor 2110 executing one or more sequences of one or more instructions (which might be incorporated into the operating system 2140 and/or other code, such as an application program 2145) contained in the working memory 2135. Such instructions may be read into the working memory 2135 from another computer-readable medium, such as one or more of the non-transitory storage device(s) 2125. Merely by way of example, execution of the sequences of instructions contained in the working memory 2135 might cause the processor(s) 2110 to perform one or more procedures of the methods described herein.

The terms "machine-readable medium," "computer-readable storage medium" and "computer-readable medium," as used herein, refer to any medium that participates in providing data that causes a machine to operate in a specific fashion. These mediums may be non-transitory. In an embodiment implemented using the computer system 2100, various computer-readable media might be involved in providing instructions/code to processor(s) 2110 for execution and/or might be used to store and/or carry such instructions/code. In many implementations, a computer-readable medium is a physical and/or tangible storage medium. Such a medium may take the form of a non-volatile media or volatile media. Non-volatile media include, for example, optical and/or magnetic disks, such as the non-transitory storage device(s) 2125. Volatile media include, without limitation, dynamic memory, such as the working memory 2135.

Common forms of physical and/or tangible computer-readable media include, for example, a floppy disk, a flexible disk, hard disk, magnetic tape, or any other magnetic medium, a CD-ROM, any other optical medium, any other physical medium with patterns of marks, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 2110 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer system 2100.

The communications subsystem 2130 (and/or components thereof) generally will receive signals, and the bus 2105 then might carry the signals (and/or the data, instructions, etc. carried by the signals) to the working memory 2135, from which the processor(s) 2110 retrieves and executes the instructions. The instructions received by the working memory 2135 may optionally be stored on a non-transitory storage device 2125 either before or after execution by the processor(s) 2110.

It should further be understood that the components of computer system 2100 can be distributed across a network. For example, some processing may be performed in one location using a first processor while other processing may be performed by another processor remote from the first processor. Other components of computer system 2100 may be similarly distributed. As such, computer system 2100 may be interpreted as a distributed computing system that performs processing in multiple locations. In some instances, computer system 2100 may be interpreted as a single computing device, such as a distinct laptop, desktop computer, or the like, depending on the context.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

What is claimed is:

1. A hazard detector, comprising:

a smoke chamber;

an electromagnetic radiation sensor positioned to receive electromagnetic radiation within the smoke chamber; and a first electromagnetic radiation emitter that emits electromagnetic radiation at a first wavelength into the smoke chamber;

a second electromagnetic radiation emitter that emits electromagnetic radiation at a second wavelength into the smoke chamber; and a processing system that controls activation of the first electromagnetic radiation emitter and the second electromagnetic radiation emitter, the processing system:

operating the hazard detector in a first mode, during which the processing system:

causes the first electromagnetic radiation emitter to emit the first wavelength of electromagnetic radiation into the smoke chamber at a first periodic rate; and causes the second electromagnetic radiation emitter to emit the second wavelength of electromagnetic radiation into the smoke chamber at a second periodic rate that is lower than the first periodic rate; and operating the hazard detector in a second mode, during which the processing system:

causes the first electromagnetic radiation emitter to emit the first wavelength of electromagnetic radiation into the smoke chamber at a third periodic rate that is higher than the first periodic rate; and causes the second electromagnetic radiation emitter to emit the second wavelength of electromagnetic radiation into the smoke chamber at a fourth periodic rate that is higher than the second periodic rate.

2. The hazard detector of claim 1, wherein the second electromagnetic radiation emitter is activated in the first mode at the second periodic rate for testing functionality of the second electromagnetic radiation emitter.

3. The hazard detector of claim 1, wherein the first and second electromagnetic radiation emitters are light emitting diodes (LEDs) and the electromagnetic radiation sensor is a photodiode.

4. The hazard detector of claim 1, wherein the hazard detector is exclusively battery powered.

5. The hazard detector of claim 1, wherein the first wavelength emitted by the first electromagnetic radiation emitter is infrared and the second wavelength emitted by the second electromagnetic radiation emitter is blue light.

6. The hazard detector of claim 1, wherein the processing system operates the hazard detector in the second mode based on at least a threshold amount of smoke being detected within the smoke chamber using the electromagnetic radiation sensor.

7. The hazard detector of claim 1, wherein the first electromagnetic radiation emitter and the second electromagnetic radiation emitter each have horizontal offset angles of between 10 and 35 degrees from the electromagnetic radiation sensor within the smoke chamber.

8. The hazard detector of claim 1, wherein the processing system, while in the second mode, further:

calculates a metric value based on a first measurement made by the electromagnetic radiation sensor measuring the first wavelength of electromagnetic radiation and a second measurement made by the electromagnetic radiation sensor measuring the second wavelength of electromagnetic radiation.

9. The hazard detector of claim 8, wherein the processing system, in calculating the metric value, scales the first measurement by a first scaling value and the second measurement by a second scaling value.

10. The hazard detector of claim 9, wherein the processing system further evaluates a rolling window of a plurality of metric values, comprising the metric value, to determine whether to activate an alarm of the hazard detector.

11. The hazard detector of claim 1, wherein the fourth periodic rate is the same as the third periodic rate.

12. A method for operating a hazard detector, comprising:

operating, by a processing system of the hazard detector, in a first mode, comprising:

causing a first electromagnetic radiation emitter of the hazard detector to emit a first wavelength of electromagnetic radiation into a smoke chamber of the hazard detector at a first periodic rate; and causing a second electromagnetic radiation emitter of the hazard detector to emit a second wavelength of electromagnetic radiation into the smoke chamber at a second periodic rate that is lower than the first periodic rate; and operating, by the processing system, in a second mode, comprising:

causing the first electromagnetic radiation emitter to emit the first wavelength of electromagnetic radiation into the smoke chamber at a third periodic rate that is higher than the first periodic rate; and causing the second electromagnetic radiation emitter to emit the second wavelength of electromagnetic radiation into the smoke chamber at a fourth periodic rate that is higher than the second periodic rate.

13. The method of operating the hazard detector of claim 12, wherein causing the second electromagnetic radiation emitter to be activated in the first mode at the second periodic rate is for testing functionality of the second electromagnetic radiation emitter.

14. The method of operating the hazard detector of claim 12, further comprising: powering, exclusively using one or more batteries, the first electromagnetic radiation emitter, the second electromagnetic radiation emitter, an electromagnetic radiation sensor, and the processing system.

15. The method of operating the hazard detector of claim 12, wherein the first wavelength emitted by the first electromagnetic radiation emitter is infrared and the second wavelength emitted by the second electromagnetic radiation emitter is blue light.

16. The method for operating the hazard detector of claim 12, wherein operating the hazard detector in the second mode is at least partially based on at least a threshold amount of smoke being detected within the smoke chamber using an electromagnetic radiation sensor.

17. The method for operating the hazard detector of claim 12, further comprising:

calculating a metric value based on a first measurement made by an electromagnetic radiation sensor measuring the first wavelength of electromagnetic radiation and a second measurement made by the electromagnetic radiation sensor measuring the second wavelength of electromagnetic radiation.

18. The method of operating the hazard detector of claim 17, further comprising: evaluating a rolling window of a plurality of metric values, comprising the metric value, to determine whether to activate a warning or an alarm of the hazard detector.

19. The method of operating the hazard detector of claim 17, wherein the fourth periodic rate is the third periodic rate.

20. A non-transitory processor-readable medium comprising processor-readable instructions for execution by a hazard detector, the processor-readable instructions causing one or more processors of the hazard detector to:

operate in a first mode, the first mode comprising:

causing a first electromagnetic radiation emitter of the hazard detector to emit a first wavelength of electromagnetic radiation into a smoke chamber of the hazard detector at a first periodic rate; and causing a second electromagnetic radiation emitter of the hazard detector to emit a second wavelength of electromagnetic radiation into the smoke chamber at a second periodic rate that is lower than the first periodic rate; and operate in a second mode, the second mode comprising:

causing the first electromagnetic radiation emitter to emit the first wavelength of electromagnetic radiation into the smoke chamber at a third periodic rate that is higher than the first periodic rate; and causing the second electromagnetic radiation emitter to emit the second wavelength of electromagnetic radiation into the smoke chamber at a fourth periodic rate greater than the second periodic rate.

* * * * *